US010141176B2

(12) United States Patent
Stewart et al.

(10) Patent No.: US 10,141,176 B2
(45) Date of Patent: Nov. 27, 2018

(54) MULTI-REFLECTION MASS SPECTROMETER WITH DECELERATION STAGE

(71) Applicant: Thermo Fisher Scientific (Bremen) GmbH, Bremen (DE)

(72) Inventors: Hamish Stewart, Bremen (DE); Dmitry Grinfeld, Bremen (DE); Alexander A. Makarov, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 15/801,168

(22) Filed: Nov. 1, 2017

(65) Prior Publication Data

US 2018/0138026 A1 May 17, 2018

(30) Foreign Application Priority Data

Nov. 4, 2016 (GB) ..... 1618595.1

(51) Int. Cl.
*H01J 49/40* (2006.01)
*H01J 49/00* (2006.01)
*H01J 49/06* (2006.01)

(52) U.S. Cl.
CPC ..... *H01J 49/406* (2013.01); *H01J 49/0031* (2013.01); *H01J 49/061* (2013.01)

(58) Field of Classification Search
USPC ..... 250/287, 281, 282
See application file for complete search history.

(56) References Cited

U.S. PATENT DOCUMENTS

| | | | | |
|---|---|---|---|---|
| 9,679,758 | B2 * | 6/2017 | Grinfeld | H01J 49/406 |
| 2006/0214100 | A1 * | 9/2006 | Verentchikov | H01J 49/406 250/287 |
| 2015/0028198 | A1 * | 1/2015 | Grinfeld | H01J 49/06 250/282 |
| 2016/0018368 | A1 | 1/2016 | Sapargaliyev | |

FOREIGN PATENT DOCUMENTS

| | | | |
|---|---|---|---|
| JP | 2007-526596 | A | 9/2007 |
| JP | 2015-506566 | A | 3/2015 |
| WO | 2008/047891 | A2 | 4/2008 |
| WO | 2013/110587 | A2 | 8/2013 |

* cited by examiner

*Primary Examiner* — Kiet T Nguyen
(74) *Attorney, Agent, or Firm* — Charles B. Katz

(57) ABSTRACT

Disclosed herein is a multi-reflection mass spectrometer comprising two ion mirrors spaced apart and opposing each other in an X direction, each mirror elongated along a drift direction Y orthogonal to the direction X, and an ion injector for injecting ions as an ion beam into the space between the ion mirrors at an inclination angle to the X direction. Along a first portion of their length in the drift direction Y the ion mirrors converge with a first degree of convergence, and along a second portion of their length in the drift direction Y the ion mirrors converge with a second degree of convergence or are parallel, the first portion of their length being closer to the ion injector than the second portion and the first degree of convergence being greater than the second degree of convergence.

40 Claims, 15 Drawing Sheets

MULTI-REFLECTION MASS SPECTROMETER WITH DECELERATION STAGE

FIELD

This invention relates to the field of mass spectrometry, in particular time-of-flight mass spectrometry, especially high mass resolution time-of-flight mass spectrometry, and electrostatic trap mass spectrometry utilizing multi-reflection techniques for extending the ion flight path.

BACKGROUND

Various arrangements utilizing multi-reflection to extend the flight path of ions within mass spectrometers are known. Flight path extension is desirable to increase time-of-flight separation of ions within time-of-flight (TOF) mass spectrometers or to increase the trapping time of ions within electrostatic trap (EST) mass spectrometers. In both cases the ability to distinguish small mass differences between ions is thereby improved. Improved resolving power, along with advantages in increased mass accuracy and sensitivity that typically come with it, is an important attribute for a mass spectrometer for a wide range of applications, particularly with regard to applications in biological science, such as proteomics and metabolomics for example.

An arrangement of two parallel opposing mirrors was described by Nazarenko et. al. in patent SU1725289. These mirrors were elongated in a drift direction and ions followed a zigzag flight path, reflecting between the mirrors and at the same time drifting relatively slowly along the extended length of the mirrors in the drift direction. Each mirror was made of parallel bar electrodes. The number of reflection cycles and the mass resolution achieved were able to be adjusted by altering the ion injection angle. The design was advantageously simple in that only two mirror structures needed to be produced and aligned to one another. However this system lacked any means to prevent beam divergence in the drift direction. Due to the initial angular spread of the injected ions, after multiple reflections the beam width may exceed the width of the detector making any further increase of the ion flight time impractical due to the loss of sensitivity. Ion beam divergence is especially disadvantageous if trajectories of ions that have undergone a different number of reflections overlap, thus making it impossible to detect only ions having undergone a given number of oscillations. As a result, the design has a limited angular acceptance and/or limited maximum number of reflections. Furthermore, the ion mirrors did not provide time-of-flight focusing with respect to the initial ion beam spread across the plane of the folded path, resulting in degraded time-of-flight resolution for a wide initial beam angular divergence.

Wollnik, in GB patent 2080021, described various arrangements of parallel opposing gridless ion mirrors. Two rows of mirrors in a linear arrangement and two opposing rings of mirrors were described. Some of the mirrors may be tilted to effect beam injection. Each mirror was rotationally symmetric and was designed to produce spatial focusing characteristics so as to control the beam divergence at each reflection, thereby enabling a longer flight path to be obtained with low beam losses. However these arrangements were complex to manufacture, being composed of multiple high-tolerance mirrors that required precise alignment with one another. The number of reflections as the ions passed once through the analyser was fixed by the number of mirrors and could not be altered.

Su described a gridded parallel plate mirror arrangement elongated in a drift direction, in International Journal of Mass Spectrometry and Ion Processes, 88 (1989) 21-28. The opposing ion reflectors were arranged to be parallel to each other and ions followed a zigzag flight path for a number of reflections before reaching a detector. The system had no means for controlling beam divergence in the drift direction, and this, together with the use of gridded mirrors which reduced the ion flux at each reflection, limited the useful number of reflections and hence flight path length.

Verentchikov, in WO2005/001878 and GB2403063 described the use of periodically spaced lenses located within the field free region between two parallel elongated opposing mirrors. The purpose of the lenses was to control the beam divergence in the drift direction after each reflection, thereby enabling a longer flight path to be advantageously obtained over the elongated mirror structures described by Nazarenko at al. and Su. To further increase the path length, it was proposed that a deflector be placed at the distal end of the mirror structure from the ion injector, so that the ions may be deflected back through the mirror structure, doubling the flight path length. However the use of a deflector in this way is prone to introducing beam aberrations which would ultimately limit the maximum resolving power that could be obtained. In this arrangement the number of reflections is set by the position of the lenses and there is not the possibility to change the number of reflections and thereby the flight path length by altering the ion injection angle. The construction is also complex, requiring precise alignment of the multiple lenses. Lenses and the end deflector are furthermore known to introduce beam aberrations and ultimately this placed limits on the types of injection devices that could be used and reduced the overall acceptance of the analyser. In addition, the beam remains tightly focused over the entire path making it more susceptible to space charge effects.

Makarov et. al., in WO2009/081143, described a further method of introducing beam focusing in the drift direction for a multi-reflection elongated TOF mirror analyser. Here, a first gridless elongated mirror was opposed by a set of individual gridless mirrors elongated in a perpendicular direction, set side by side along the drift direction parallel to the first elongated mirror. The individual mirrors provided beam focusing in the drift direction. Again in this arrangement the number of beam oscillations within the device is set by the number of individual mirrors and cannot be adjusted by altering the beam injection angle. Whilst less complex than the arrangement of Wollnik and that of Verentchikov, nevertheless this construction is more complex than the arrangement of Nazarenko et. al. and that of Su.

Golikov, in WO2009001909, described two asymmetrical opposed mirrors, arranged parallel to one another. In this arrangement the mirrors, whilst not rotationally symmetric, did not extend in a drift direction and the mass analyzer typically has a narrow mass range because the ion trajectories spatially overlap on different oscillations and cannot be separated. The use of image current detection was proposed.

A further proposal for providing beam focusing in the drift direction in a system comprising elongated parallel opposing mirrors was provided by Verentchikov and Yavor in WO2010/008386. In this arrangement periodic lenses were introduced into one or both the opposing mirrors by periodically modulating the electric field within one or both the mirrors at set spacings along the elongated mirror structures. Again in this construction the number of beam oscillations cannot be altered by changing the beam injection angle, as the beam must be precisely aligned with the modulations in one or both the mirrors. Each mirror is somewhat more complex in construction than the simple planar mirrors proposed by Nazarenko et. al.

A somewhat related approach was proposed by Ristroph et. al. in US2011/0168880. Opposing elongated ion mirrors comprise mirror unit cells, each having curved sections to provide focusing in the drift direction and to compensate partially or fully for a second order time-of-flight aberration with respect to the drift direction. In common with other arrangements, the number of beam oscillations cannot be altered by changing the beam injection angle, as the beam must be precisely aligned with the unit cells. Again the mirror construction is more complex than that of Nazarenko et. al.

All arrangements which maintain the ions in a narrow beam in the drift direction with the use of periodic structures necessarily suffer from the effects of space-charge repulsion between ions.

Sudakov, in WO2008/047891, proposed an alternative means for both doubling the flight path length by returning ions back along the drift length and at the same time inducing beam convergence in the drift direction. In this arrangement the two parallel gridless mirrors further comprise a third mirror oriented perpendicularly to the opposing mirrors and located at the distal end of the opposing mirrors from the ion injector. The ions are allowed to diverge in the drift direction as they proceed through the analyser from the ion injector, but the third ion mirror reverts this divergence and, after reflection in the third mirror, upon arriving back in the vicinity of the ion injector the ions are once again converged in the drift direction. This advantageously allows the ion beam to be spread out in space throughout most of its journey through the analyser, reducing space charge interactions, as well as avoiding the use of multiple periodic structures along or between the mirrors for ion focusing. The third mirror also induces spatial focussing with respect to initial ion energy in the drift direction. There being no individual lenses or mirror cells, the number of reflections can be set by the injection angle. However, the third mirror is necessarily built into the structure of the two opposing elongated mirrors and effectively sections the elongated mirrors, i.e. the elongated mirrors are no longer continuous—and nor is the third mirror. This has the disadvantageous effect of inducing a discontinuous returning force upon the ions due to the step-wise change in the electric field in the gaps between the sections. This is particularly significant since the sections occur near the turning point in the drift direction where the ion beam width is at its maximum. This can lead to uncontrolled ion scattering and differing flight times for ions reflected within more than one section during a single oscillation.

Recently, US2015/0028197 described a multi-reflection mass spectrometer comprised of two ion mirrors, opposing each other in the X direction and both being generally elongated in the drift direction Y. Ions injected into the instrument are repeatedly reflected back and forth in X direction between the mirrors, whilst they drift down the Y direction of mirror elongation. Overall, the ion motion follows a zigzag path. The mirrors have a convergence with increasing Y, thereby creating a pseudo-potential gradient along the Y axis that acts as an ion mirror to reverse the ion drift velocity along Y and spatially focus the ions in Y to a focal point where a detector is placed. Thus, the pseudo-potential gradient along the Y axis enables the ion motion to be reversed without actually requiring a third ion mirror as described in Sudakov.

In view of the above, however, improvements are still desired, for example in resolving power.

SUMMARY OF THE INVENTION

According to an aspect of the present invention there is provided a multi-reflection mass spectrometer comprising two ion mirrors spaced apart and opposing each other in an X direction, each mirror elongated generally along a drift direction Y, the X direction being orthogonal to the drift direction Y, and an ion injector for injecting ions as an ion beam into the space between the ion mirrors at an inclination angle to the X direction, wherein along a first portion of their length in the drift direction Y the ion mirrors converge with a first degree of convergence and along a second portion of their length in the drift direction Y the ion mirrors converge with a second degree of convergence or are parallel, the first portion of their length being closer to the ion injector than the second portion and the first degree of convergence being greater than the second degree of convergence. Preferably, at least one of the ion mirrors along the first portion of its length in the drift direction Y has a first non-zero angle of inclination to the direction Y and along the second portion of its length in the drift direction Y has a second non-zero angle of inclination to the direction Y that is less than the first non-zero angle of inclination to the direction Y or has zero angle of inclination to the direction Y. Preferably, the ion mirrors along the first portion of their length in the drift direction Y provide a first return pseudo-potential gradient for reducing the ion drift velocity in the drift direction Y, and the ion mirrors along the second portion of their length in the drift direction Y provide a second return pseudo-potential gradient for reducing the ion drift velocity in the drift direction Y or along the second portion of their length do not provide a return pseudo-potential, wherein the first return pseudo-potential gradient is greater than the second return pseudo-potential gradient. Preferably, the ion mirrors along the first portion of their length in the drift direction Y provide a first rate of deceleration of the ion drift velocity in the drift direction Y, and the ion mirrors along the second portion of their length in the drift direction Y provide a second rate of deceleration of the ion drift velocity in the drift direction Y or along the second portion of their length do not provide a deceleration of the ion drift velocity in the drift direction Y, wherein the first rate of deceleration of the ion drift velocity is greater than the second rate of deceleration of the ion drift velocity.

According to another aspect of the present invention there is provided a multi-reflection mass spectrometer comprising two ion mirrors spaced apart and opposing each other in an X direction, each mirror elongated generally along a drift direction Y, the X direction being orthogonal to the drift direction Y, and an ion injector for injecting ions as an ion beam into the space between the ion mirrors at an inclination angle to the X direction, wherein at least one of the ion mirrors along a first portion of its length in the drift direction Y has a first non-zero angle of inclination to the direction Y and along a second portion of its length in the drift direction Y has a second non-zero angle of inclination to the direction Y that is less than the first non-zero angle of inclination to the direction Y or has zero angle of inclination to the direction Y, the first portion of length being closer to the ion injector than the second portion. Preferably, along the first portion of their length in the drift direction Y the ion mirrors converge with a first degree of convergence and along the second portion of their length in the drift direction Y the ion mirrors converge with a second degree of convergence or are parallel, the first degree of convergence being greater than the second degree of convergence. Preferably, the ion mirrors along the first portion of their length in the drift direction Y provide a first return pseudo-potential gradient for reducing the ion drift velocity in the drift direction Y, and the ion mirrors along the second portion of their length in the drift direction Y provide a second return pseudo-potential gradient for reducing the ion drift velocity in the drift direction Y or along the second portion of their length do not provide a return pseudo-potential, wherein the first return pseudo-potential gradient is greater than the second return pseudo-potential gradient. Preferably, the ion mirrors along the first portion of their length in the drift direction Y provide a first rate of deceleration of the ion drift velocity in the drift direction Y, and the ion mirrors along the second portion of their length in the drift direction Y provide a second rate of deceleration of the ion drift velocity in the drift direction Y or along the second portion of their length do not provide a deceleration of the ion drift velocity in the drift direction Y, wherein the first rate of deceleration of the ion drift velocity is greater than the second rate of deceleration of the ion drift velocity.

According to still another aspect of the present invention there is provided a multi-reflection mass spectrometer comprising two ion mirrors spaced apart and opposing each other in an X direction, each mirror elongated generally along a drift direction Y, the X direction being orthogonal to the drift direction Y, and an ion injector for injecting ions as an ion beam into the space between the ion mirrors at an inclination angle to the X direction, wherein the ion mirrors along a first portion of their length in the drift direction Y provide a first return pseudo-potential gradient for reducing the ion drift velocity in the drift direction Y, and the ion mirrors along a second portion of their length in the drift direction Y provide a second return pseudo-potential gradient for reducing the ion drift velocity in the drift direction Y or along the second portion of their length do not provide a return pseudo-potential, wherein the first return pseudo-potential gradient is greater than the second return pseudo-potential gradient and the first portion of length is closer to the ion injector than the second portion. Preferably, along the first portion of their length in the drift direction Y the ion mirrors converge with a first degree of convergence and along the second portion of their length in the drift direction Y the ion mirrors converge with a second degree of convergence or are parallel, the first degree of convergence being greater than the second degree of convergence. Preferably, at least one of the ion mirrors along the first portion of its length in the drift direction Y has a first non-zero angle of inclination to the direction Y and along the second portion of its length in the drift direction Y has a second non-zero angle of inclination to the direction Y that is less than the first non-zero angle of inclination to the direction Y or has zero angle of inclination to the direction Y. Preferably, the ion mirrors along the first portion of their length in the drift direction Y provide a first rate of deceleration of the ion drift velocity in the drift direction Y, and the ion mirrors along the second portion of their length in the drift direction Y provide a second rate of deceleration of the ion drift velocity in the drift direction Y or along the second portion of their length do not provide a deceleration of the ion drift velocity in the drift direction Y, wherein the first rate of deceleration of the ion drift velocity is greater than the second rate of deceleration of the ion drift velocity.

According to still another aspect of the present invention there is provided a multi-reflection mass spectrometer comprising two ion mirrors spaced apart and opposing each other in an X direction, each mirror elongated generally along a drift direction Y, the X direction being orthogonal to the drift direction Y, and an ion injector for injecting ions as an ion beam into the space between the ion mirrors at an inclination angle to the X direction, wherein the ion mirrors along a first portion of their length in the drift direction Y provide a first rate of deceleration of the ion drift velocity in the drift direction Y, and the ion mirrors along a second portion of their length in the drift direction Y provide a second rate of deceleration of the ion drift velocity in the drift direction Y or along the second portion of their length do not provide a deceleration of the ion drift velocity in the drift direction Y, wherein the first rate of deceleration of the ion drift velocity is greater than the second rate of deceleration of the ion drift velocity and the first portion of length is closer to the ion injector than the second portion. Preferably, along the first portion of their length in the drift direction Y the ion mirrors converge with a first degree of convergence and along the second portion of their length in the drift direction Y the ion mirrors converge with a second degree of convergence or are parallel, the first degree of convergence being greater than the second degree of convergence. Preferably, at least one of the ion mirrors along the first portion of its length in the drift direction Y has a first non-zero angle of inclination to the direction Y and along the second portion of its length in the drift direction Y has a second non-zero angle of inclination to the direction Y that is less than the first non-zero angle of inclination to the direction Y or has zero angle of inclination to the direction Y. Preferably, the ion mirrors along the first portion of their length in the drift direction Y provide a first return pseudo-potential gradient for reducing the ion drift velocity in the drift direction Y, and the ion mirrors along the second portion of their length in the drift direction Y provide a second return pseudo-potential gradient for reducing the ion drift velocity in the drift direction Y or along the second portion of their length do not provide a return pseudo-potential, wherein the first return pseudo-potential gradient is greater than the second return pseudo-potential gradient.

In these embodiments, preferably, the ions injected into the spectrometer are repeatedly reflected back and forth in the X direction between the mirrors, whilst they drift down the Y direction of mirror elongation so as to follow a zigzag path though the spectrometer. The return pseudo potential gradient, for example provided by the converging or inclined ion mirrors, provides an opposing electric field that causes the ions to eventually reverse their direction and travel back along direction Y towards the ion injector, again to follow a zigzag path.

A convergence of the mirrors means that the distance between the opposing ion mirrors in the X direction becomes less with increasing displacement along direction Y away from the ion injector. The degree of convergence is the rate of change of the distance between the opposing ion mirrors in the X direction with displacement along direction Y away from the ion injector, i.e. the amount of change of the distance between the opposing ion mirrors in the X direction per unit of displacement along direction Y away from the ion injector. Thus, the converging mirrors have an angle of convergence between them. A convergence of the mirrors or non-zero angle of inclination of a mirror to the direction Y or return pseudo-potential is such as to cause a reduction in the ion drift velocity (velocity of the ions in the drift direction Y) when ions are reflected in the mirror, i.e. when the ions are moving in a +Y direction away from the ion injector following ion injection. Preferably, a reduction in ion drift velocity is caused by each reflection in an ion mirror where the mirrors are converging or have a non-zero angle of inclination to the direction Y. The mirror convergence or non-zero angle of inclination of a mirror with increasing Y, i.e. along the second portion of the length in direction Y, creates a pseudo-potential gradient along the Y axis that acts as an ion mirror to reduce the ion drift velocity and can eventually reverse the ion drift velocity along Y (i.e. ion drift velocity becomes velocity in −Y direction). Reduction of the ion drift velocity herein can include reducing the drift velocity to a negative or more negative value (i.e. reverse velocity, or velocity in the −Y direction, which is towards the ion injector). The one or more reflections of the ion beam from at least one of the mirrors in the first portion of length of the mirrors (preferably a single reflection from one of the mirrors in the first portion of length) and preferably the reflections of the ion beam from the mirrors in the second portion of length provide a deceleration of the ion drift velocity in the drift direction Y as the ions move away from the ion injector following ion injection. The rate of deceleration of the ion drift velocity in the drift direction Y herein is regarded as the rate of change of the drift velocity per unit length of the mirrors in the direction Y or per unit time, for an ion of a given mass to charge ratio moving away from the ion injector.

The drift velocity of the ions in the direction Y can be substantially reduced by at least one reflection in at least one of the ion mirrors in the first portion of length in the direction Y. The ions exhibit a substantially greater average reduction in their drift velocity in the direction Y by a reflection in at least one of the ion mirrors in the first portion of length in the direction Y (where mirror convergence or angle of inclination is greater) compared to the average reduction in their drift velocity in the direction Y for a reflection in at least one of the ion mirrors in the second portion of length in the direction Y (where mirror convergence or angle of inclination is less or not present). The average reduction in the drift velocity in the direction Y, for each of the first and second portions of length along Y, means the average reduction in their drift velocity per reflection in that portion (i.e. average of all reflections in that portion).

Preferably, the first degree of convergence or non-zero angle of inclination to the direction Y, or return pseudo potential etc. is such that the drift velocity of the ions in the direction Y is reduced across the first portion of length by at least 5%, or at least 20%, or an amount in the range 5-50%, or an amount in the range 20-50% after the ions undergo one or more reflections in the ion mirrors in the first portion of length. Preferably, on average (mean averaged over all of the one or more reflections) the ions exhibit a greater or substantially greater reduction (e.g. >5%, >10%, or >20%) in their drift velocity in the direction Y per reflection in at least one of the ion mirrors in the first portion of length in the direction Y compared to the average reduction in their drift velocity in the direction Y per reflection in the ion mirrors in the second portion of length in the direction Y.

Thus it can be seen that the invention provides a multi-reflection mass spectrometer with a higher initial (post-injection) deceleration stage.

The ion injector for injecting ions as an ion beam into the space between the ion mirrors at an inclination angle to the X direction preferably lies in the X-Y plane. Thereafter, the injected ions following their zigzag path between the ion mirrors in the X-Y plane. However, the ion injector can lie outside the X-Y plane such that ions are injected towards the X-Y plane and are deflected by a deflector when they reach the X-Y plane to thereafter follow their zigzag path between the ion mirrors in the X-Y plane. Ions injected into the spectrometer are preferably repeatedly reflected back and forth in the X direction between the mirrors, whilst they drift down the Y direction of mirror elongation (in the +Y direction). Overall, the ion motion follows a zigzag path. In certain embodiments, the ions are allowed to reverse their drift velocity along Y and be repeatedly reflected back and forth in the X direction between the mirrors whilst they drift back up the Y direction (in the −Y direction). In this way, the ions travel back towards their point of injection in the Y direction due to the mirrors having a convergence with increasing Y, thereby creating a pseudo-potential gradient along the Y axis that acts as an ion mirror to reverse the ion drift velocity along Y, which can spatially focus the ions in Y direction to a focal point at or near the point of injection, where a detector can also be placed. The detector can be positioned substantially at or near to the same Y position as the ion injector. In some embodiments, for example where there is no mirror convergence in the second portion or where there is no angle of inclination of the mirrors to the Y axis, a return pseudo-potential gradient may not be present and the ions may not be returned through the space between the mirrors. In such embodiments, a detector may instead be placed at the opposite end of the ion mirrors to the ion injector. However, such embodiments, without a return pseudo potential to reverse the direction of ion drift velocity, are less preferred due to the absence of spatial focussing at the detector. However, such embodiments, with a parallel mirror arrangement in the second portion of length may be improved by employing so-called periodic lenses, for example as described in WO2005/001878 and GB2403063 wherein the use of periodically spaced lenses located within the field free region between two parallel elongated opposing mirrors enables control of the beam divergence in the drift direction after each reflection, thereby enabling a longer flight path to be advantageously obtained over the elongated mirror structures. Thus, along the second portion of their length in the drift direction Y, the ion mirrors in some embodiments can be substantially non-parallel but in other embodiments can be substantially parallel.

The invention enables an initial higher reduction of the post-injection drift velocity in the direction +Y by modifying or altering the return pseudo-potential generated by the converging mirrors along an initial portion of the length, i.e. the first portion of the length along the direction Y, relative to the return pseudo-potential generated by the converging mirrors along a subsequent portion of the length, i.e. the second portion of the length along the direction Y. The return pseudo-potential generated by the converging mirrors along the first portion of the length is thus higher than the return pseudo-potential generated by the converging mirrors along the second portion of the length as the ions move in the +Y direction after injection. The invention can enable the drift velocity of the ions in the direction Y to be more rapidly reduced, at the beginning of the reflected path through the spectrometer, by allowing the ions to undergo at least one reflection in at least one of the mirrors in the first portion of the length in the drift direction Y, wherein the degree of convergence between the mirrors is higher, which allows an increased number of oscillations in direction X and thus increased time of flight through the second portion of the length in the drift direction Y and an increased overall flight path through the spectrometer.

Accordingly, in certain embodiments, the ions undergo a greater reduction of drift velocity in the direction +Y after an initial reflection in the first portion of length of the mirrors than after subsequent reflections in the second portion of length of the mirrors as the ions move in the +Y direction after injection. The ions preferably undergo a single reflection in the first portion of length of the mirrors after injection in the +Y direction and undergo a plurality of reflections in the second portion of length of the mirrors as the ions move in the +Y direction. There can also be a reflection of the ions in the first portion of length after the ion drift velocity along Y has been reversed by the pseudo potential gradient formed by the converging mirrors in the second portion of length and the ions have traveled back along the second portion of length in the reverse −Y direction. In such cases, the ions preferably undergo a single reflection in the first portion of length of the mirrors after the ions have traveled back along the second portion of length in the reverse −Y direction, which may be the final reflection, immediately before detection.

In one type of embodiment, the ion mirrors converge with a greater angle, i.e. more sharply, along a first drift region of the ion mirrors, which is defined by the first portion of length in the direction Y, and converge with a lesser angle, preferably substantially lesser angle, to the direction Y, i.e. less sharply, along a second drift region, which is defined by the second portion of length in the direction Y. In some embodiments, the mirrors may not converge (i.e. may be parallel), along a second drift region, which is defined by the second portion of length. This particular two stage potential gradient contrasts to that of a simple single stage linear convergence as described in the prior art. Ion drift velocity in the direction Y is consequently rapidly reduced in the first region following injection, allowing increased time of flight through the second region and overall flight path. The invention with an initial rapid decelerating stage for the drift velocity has been found to increase the number of oscillations in the X direction by 50% or more, and thus the time of flight by 50% or more, relative to a single stage converging mirror without the initial decelerating stage.

This can be compared to the instrument described in US2015/0028197, wherein the resolving power is dependent upon the initial angle of ion injection (herein termed the inclination angle, which is the angle of ion injection to the X direction in the X-Y plane), which determines the drift velocity and therefore the overall time of flight. Ideally, this inclination angle of injection should be minimised, but such minimum can be restricted by mechanical requirements of the injection apparatus and/or of the detector, especially for more compact designs. A solution presented in the prior art is to use an additional deflector positioned between the mirrors to reduce the drift velocity after ion injection, but this potentially introduces mechanical restrictions of its own, as well as ion losses and time-of-flight aberrations that impact on the mass resolution, and of course adds to the complexity and cost of the instrument. In the present invention, no additional deflectors need to be used between the mirrors to reduce the drift velocity. In other words, the incorporation of a decelerating stage into the mirror structure itself in the invention allows for an increase of the flight time and consequent resolution to be made without the requirement for an additional deflector to be incorporated between the mirrors, thus reducing the number of parts and cost.

Accordingly, in embodiments, the mirrors are not a constant distance from each other in the X direction along at least the first and preferably second portions of their lengths in the drift direction. In certain embodiments, the mirrors are inclined to one other in the X direction along at least the first and preferably second portions of their lengths in the drift direction. The mirrors thus converge towards each other in the X direction along at least the first and preferably second portions of their lengths in the drift direction.

The present invention further provides a method of mass spectrometry comprising the steps of injecting ions into the multi-reflection mass spectrometer, for example in such form as a pulsed ion beam as known for TOF mass spectrometry, and detecting at least some of the ions during or after their passage through the mass spectrometer.

The ion injector is preferably located proximate to one end of the opposing ion-optical mirrors in the drift direction Y so that ions can be injected into the multi-reflection mass spectrometer from one end of the opposing ion-optical mirrors in the drift direction (injection in the +Y direction), wherein the ion-optical mirrors converge as they extend in the drift direction away from the location of the ion injector. Preferably, methods of mass spectrometry using the present invention further comprise injecting ions into the multi-reflection mass spectrometer from one end of the opposing ion-optical mirrors in the drift direction wherein the ion-optical mirrors converge as they extend in the drift direction away from the location of ion injection.

For convenience herein, the drift direction shall be termed the Y direction, the opposing mirrors are set apart from one another by a distance in what shall be termed the X direction, the X direction being orthogonal to the Y direction, this distance varying at different locations in the Y direction as described. The ion flight path generally occupies a volume of space which extends in the X and Y directions, the ions reflecting between the opposing mirrors (in the X direction) and at the same time progressing along the drift direction Y. The mirrors generally being of smaller dimensions in the perpendicular Z direction (Z being perpendicular to X and Y), the volume of space occupied by the ion flight path is a slightly distorted rectangular parallelepiped with a smallest dimension preferably being in the Z direction. For convenience of the description herein, ions are injected into the mass spectrometer with initial components of velocity in the +X and +Y directions, progressing initially towards a first ion-optical mirror located in a +X direction and along the drift length in a +Y direction. The average component of velocity in the Z direction is preferably zero.

Injection of the ion beam preferably is effected so that the ions in the beam initially have velocity in the +Y direction and +X direction. The injected ions preferably initially progress to the first mirror of the two opposing ion-optical mirrors located in a +X direction and are reflected therein towards the opposing mirror located in a −X direction. Preferably, the first reflection after injection with velocity in the +Y direction and +X direction occurs in the first mirror in the first portion of length along direction Y, wherein the ion mirrors converge with the first, i.e. higher, degree of convergence. This provides a rapid deceleration in the drift velocity in the direction Y to enable a longer flight time over the second portion of length along direction Y. In a more preferred embodiment, there is only one reflection of the ions, i.e. in only one of the mirrors, in the first portion of length along direction Y as the ions move in the +Y direction. In other embodiments, it can be advantageous to employ a plurality (e.g. 2, or 3, or 4, or more) of reflections in the ion mirrors in the first portion of the length along Y. There can also be a reflection of the ions in the first portion of length after the ion drift velocity along Y has been reversed by the pseudo potential gradient formed by the converging mirrors in the second portion of length and the ions have returned along the second portion of length with velocity in the −Y direction. The reflection of ions in the first portion of length after the ion drift velocity along Y has been reversed typically takes place in the opposite ion mirror to the ion mirror in which the first reflection took place and will typically be the last reflection before the ions reach a detector. The detector is preferably located near the ion injector at the end of the ion mirrors.

Preferably, no portion of the ion beam is within the mirror structure when the ion beam passes between the two different convergence stages, i.e. between the first and second portions of the length in the direction Y. Otherwise, the drift energy divergence of the ion beam will increase and the ions may scatter to an undesired degree. This condition that no portion of the ion beam is within an ion mirror when the ion beam passes between the first and second portions of the length in the direction Y imposes a minimum drift velocity into the second portion of the length that is dependent on the mirror separation and the spatial divergence of the ion beam at that point. As the ion beam diverges with increasing Y it is preferable to have the transition between the two stages as early as possible, preferably between the first and second reflections following injection. Thus, the transition between the first and second portions of the length in the direction Y preferably occurs between the first and second reflections in the opposing ion mirrors following injection. A related problem, particularly with embodiments having two linear stages that comprise a corner in the transition between the stages, is that field sag between the two stages will cause some drift energy broadening even at a distance to the point or corner that separates the two regions. Preferably, one or more correction electrodes are provided to reduce or minimise this field disturbance of electric field strength. In one embodiment, PCB based correcting electrodes can be mounted through the mirror at the point or corner where the mirror convergence changes between the first and second portions; the two faces of the PCB would have slightly different electrode track extents or applied voltages to mimic continuation of the stages. In another embodiment, a small distortion can be built in the mirror surface at the point or corner where the mirror convergence changes, so that the first stage (of higher convergence) ends with a small increase in convergence, and the second stage commences with a small decrease in convergence. This effect could also be mimicked with small pairs of electrodes hung from the mirror electrodes at the transition point between the two stages.

In other embodiments, neither the first nor second stages of convergence need be linear. The possible aberration introduced by the transition between the two stages, such as a corner in the case of linear converging stages, can be removed by effectively blending the two stages together with a smooth curve, so that aberrations in drift energy dispersion are averaged out over multiple reflections. Thus, the transition between the first and second portions of the length in the direction Y is preferably a smooth curve. Additionally, the second portion of length of the ion mirrors with lower degree of convergence can be constructed with at least a portion that follows a polynomial (preferably parabolic) mirror convergence, for example in the manner described in US2015/0028197 A1, which improves the Y spatial focus at the detector for ion beams with wide drift energy dispersion. This is preferable when handling decelerated ions as in the present invention as the drift energy dispersion increases substantially as a proportion of drift energy.

The two portions or stages of different convergence of the ion mirrors need not be formed by the same mirror sets (for example by the same (continuous) mirror electrodes). For example, each elongated ion mirror could be separated electrically at the transition point into two separate stages, or be built from entirely different structures at some added cost and complexity. However, this could have some advantage in allowing a partial retune of the spectrometer. For simplicity, the first and second portions of the length in the direction Y are provided by the same continuous electrodes.

Each mirror is preferably made of a plurality of elongated parallel bar electrodes, the electrodes elongated generally in the direction Y. Such constructions of mirrors are known in the art, for example as described in SU172528 or US2015/0028197. The elongated electrodes of the ion mirrors may be provided as mounted metal bars or as metal tracks on a PCB base. The elongated electrodes may be made of a metal having a low coefficient of thermal expansion such as Invar such that the time of flight is resistant to changes in temperature within the instrument. The electrode shape of the ion mirrors can be precisely machined or obtained by wire erosion manufacturing.

Preferably, the mass spectrometer of the present invention includes compensation electrodes in the space between the mirrors to minimise the impact of time of flight aberrations caused by the change in distance between the mirrors, as described in US2015/0028197 A1.

The most preferred angle or angles of convergence of the mirrors depends on factors including the length of the ion mirrors and the number of ion reflections required in each stage of the mirrors. As an example, for a 375 mm length, with a minimum 2.5 degree injection angle and a 20-50% ion energy reduction in the first stage or first portion of length of the ion mirrors (in 1 reflection of 18), an effective linear inclination of 0.116 degrees would be suitable, which can split into the two stages of the mirrors, for example in the following manner. The angle of convergence between the two ion mirrors in the first portion of length is preferably between 0.05-10 degrees (the preferred range covering a number of embodiments having significant variations in length and injection angle), more preferably between 0.5-1.6 degrees (this narrower range being suitable for the 375 mm model with the minimum injection angle described). The angle of convergence between the two ion mirrors in the second portion of length is preferably between 0.01-0.5 degrees (the preferred range covering embodiments having significant variations in length and injection angle, more preferably between 0.05-0.1 degrees.

The mirror length (total length of both first and second stages) is not particularly limited in the invention but preferred practical embodiments preferably have a total length in the range 300-500 mm, more preferably 350-450 mm, especially 350-400 mm.

The ion optical mirrors oppose one another. By opposing mirrors it is meant that the mirrors are oriented so that ions directed into a first mirror are reflected out of the first mirror towards a second mirror and ions entering the second mirror are reflected out of the second mirror towards the first mirror. The opposing mirrors therefore have components of electric field which are generally oriented in opposite directions and facing one another.

The multi-reflection mass spectrometer comprises two ion-optical mirrors, each mirror elongated predominantly in one direction. The elongation may be linear (i.e. straight), or the elongation may be non-linear (e.g. curved or comprising a series of small steps so as to approximate a curve), as will be further described. In some embodiments, the elongations of the first and second portions of the length are linear, and in other embodiments, the elongations of the first and second portions are non-linear, for example curved. Alternatively, in some embodiments, the elongation of the first portion is linear and the elongation of the second portion is non-linear, or vice versa (the elongation of the first portion is non-linear and the elongation of the second portion is linear). The elongation shape of each mirror may be the same or it may be different. Preferably the elongation shape for each mirror is the same. Preferably the mirrors are a pair of symmetrical mirrors. Where the elongation is linear, in some embodiments of the present invention, the mirrors are not parallel to each other. Where the elongation is non-linear, in some embodiments of the present invention at least one mirror curves towards the other mirror along at least a portion of its length in the drift direction. In certain preferred embodiments, the first and second portions of the length of one or preferably each mirror in the direction Y are curved. The curved portions of one or preferably each mirror can be constructed to follow a polynomial (preferably parabolic) mirror shape. The degree of convergence of the mirrors (i.e. the angle between the mirrors), or the angle of inclination of a mirror with respect to the direction Y, along a curved portion of the length of an ion mirror can be herein determined by a tangent to the curve. In the case of curved mirrors, where there is a range of degrees of convergence, or a range of angles of inclination, or a range of rates of deceleration etc. with respect to the direction Y, along a portion of the length, the degree of convergence, or angle of inclination or rate of deceleration etc. is herein taken to be the average, i.e. mean, of the degrees of convergence, or angles of inclination, etc. along the curved portion of the length.

The mirrors may be of any known type of elongated ion mirror. In embodiments where the one or both elongated mirrors is curved, the basic design of known elongated ion mirrors may be adapted to produce the required curved mirror. The mirrors may be gridded or the mirrors may be gridless. Preferably the mirrors are gridless.

As herein described, the two mirrors are aligned to one another so that they lie in the X-Y plane and so that the elongated dimensions of both mirrors lie generally in the drift direction Y. The mirrors are spaced apart and oppose one another in the X direction. However, in some embodiments, as the distance or gap between the mirrors is arranged to vary as a function of the drift distance, i.e. as a function of Y, the elongated dimensions of both mirrors will not lie precisely in the Y direction and for this reason the mirrors are described as being elongated generally along the drift direction Y. Thus, being elongated generally along the drift direction Y can also be understood as being elongated primarily or substantially along the drift direction Y. In embodiments of the invention the elongated dimension of at least one mirror will be at an angle to the direction Y for at least a portion of its length, for example for at least the first and second portions of its length in which the mirrors converge. Preferably the elongated dimension of both mirrors will be at an angle to the Y direction for at least a portion of their length, for example for at least the first and second portions of their length in which the mirrors converge.

Herein, in both the description and the claims, the distance between the opposing ion-optical mirrors in the X direction means the distance between the average turning points of ions within those mirrors at a given position along the drift length Y. A precise definition of the effective distance L between the mirrors that have a field-free region between them (where that is the case), is the product of the average ion velocity in the field-free region and the time lapse between two consecutive turning points. An average turning point of ions within a mirror herein means the maximum distance in the +/−X direction within the mirror that ions having average kinetic energy and average initial angular divergence characteristics reach, i.e. the point at which such ions are turned around in the X direction before proceeding back out of the mirror. Ions having a given kinetic energy in the +/−X direction are turned around at an equipotential surface within the mirror. The locus of such points at all positions along the drift direction of a particular mirror defines the turning points for that mirror, and the locus is hereinafter termed an average reflection surface. Therefore the variation in distance between the opposing ion-optical mirrors is defined by the variation in distance between the opposing average reflection surfaces of the mirrors. In both the description and claims reference to the distance between the opposing ion-optical mirrors is intended to mean the distance between the opposing average reflection surfaces of the mirrors as just defined. In the present invention, immediately before the ions enter each of the opposing mirrors at any point along the elongated length of the mirrors they possess their original kinetic energy in the +/−X direction. The distance between the opposing ion-optical mirrors may therefore also be defined as the distance between opposing equipotential surfaces where the nominal ions (those having average kinetic energy and average initial angular incidence) turn in the X direction, the said equipotential surfaces extending along the elongated length of the mirrors.

In the present invention, the mechanical construction of the mirrors themselves may appear, under superficial inspection, to maintain a constant distance apart in X as a function of Y, whilst the average reflection surfaces may actually be at differing distances apart in X as a function of Y. For example, one or more of the opposing ion-optical mirrors may be formed from conductive tracks disposed upon an insulating former (such as a printed circuit board) and the former of one such mirror may be arranged a constant distance apart from an opposing mirror along the whole of the drift length whilst the conductive tracks disposed upon the former may not be a constant distance from electrodes in the opposing mirror. Even if electrodes of both mirrors are arranged a constant distance apart along the whole drift length, different electrodes may be biased with different electrical potentials within one or both mirrors along the drift lengths, causing the distance between the opposing average reflection surfaces of the mirrors to vary along the drift length. Thus, the distance between the opposing ion-optical mirrors in the X direction varies along at least a portion of the length of the mirrors in the drift direction.

Preferably the variation in distance between the opposing ion-optical mirrors in the X direction varies smoothly as a function of the drift distance. In some embodiments of the present invention the variation in distance between the opposing ion-optical mirrors in the X direction varies linearly as a function of the drift distance, or in two linear stages, i.e. the distance between the opposing ion-optical mirrors in the X direction varies as a first linear function of the drift distance for the first portion of the length and varies as a second linear function of the drift distance for the second portion of the length, the first linear function having a higher gradient than the second linear function (i.e. the distance between the opposing ion-optical mirrors in the X direction varying more greatly as a function of the drift distance for the first linear function than the second). In some embodiments of the present invention the variation in distance between the opposing ion-optical mirrors in the X direction varies non-linearly as a function of the drift distance.

In some embodiments of the present invention the opposing mirrors are elongated linearly generally in the drift direction and are not parallel to each other (i.e. they are inclined to one another) along their whole length) and in such embodiments the variation in distance between the opposing ion-optical mirrors in the X direction varies linearly as a function of the drift distance (especially in two linear stages). In a preferred embodiment the two mirrors are further apart from each other at one end, that end being in a region adjacent an ion injector, i.e. the elongated ion-optical mirrors are closer together in the X direction along at least a portion of their lengths as they extend in the drift direction away from the ion injector, i. e. the mirrors converge. In some embodiments of the present invention at least one mirror and preferably each mirror curves towards or away from the other mirror along at least a portion of its length in the drift direction and in such embodiments the variation in distance between the opposing ion-optical mirrors in the X direction varies non-linearly as a function of the drift distance. In a preferred embodiment both mirrors are shaped so as to produce in one or both of the first and second portions of length a curved reflection surface, that reflection surface following a polynomial (preferably parabolic) shape so as to curve towards each other as they extend in the drift direction away from the location of an ion injector. In such embodiments the two mirrors are therefore further apart from each other at one end, in a region adjacent an ion injector. Some embodiments of the present invention provide the advantages that both an extended flight path length and spatial focusing of ions in the drift (Y) direction is accomplished by use of non-parallel mirrors. Such embodiments advantageously need no additional components to both double the drift length by causing ions to turn around and proceed back along the drift direction (i.e. travelling in the −Y direction) towards an ion injector and to induce spatial focusing of the ions along the Y direction when they return to the vicinity of the ion injector—only two opposing mirrors need be utilised. A further advantage accrues from an embodiment in which the opposing mirrors are curved towards each other with polynomial (preferably parabolic) profiles as they elongate away from one end of the spectrometer adjacent an ion injector as this particular geometry further advantageously causes the ions to take the same time to return to their point of injection independent of their initial drift velocity.

The two elongated ion-optical mirrors may be similar to each other or they may differ. For example, one mirror may comprise a grid whilst the other may not; one mirror may comprise a curved portion whilst the other mirror may be straight. Preferably both mirrors are gridless and similar to each other. Most preferably the mirrors are gridless and symmetrical. One of the simplest designs incorporating the invention would comprise symmetrical mirrors that converge in at least two stages, for example in two linear stages, i.e. in which both ion optical mirrors are matched. In some embodiments, it could be designed so that only one mirror has the higher inclination to the Y direction, for example the mirror which the ions first reach after injection.

Preferably, an ion injector injects ions from one end of the mirrors into the space between the mirrors at an inclination angle to the X axis in the X-Y plane such that ions are reflected from one opposing mirror to the other a plurality of times whilst drifting along the drift direction away from the ion injector so as to follow a generally zigzag path within the mass spectrometer. The motion of ions along the drift direction is opposed by an electric field component resulting from the non-constant distance of the mirrors from each other along at least a portion of their lengths in the drift direction, for example the converging first and second portions of length of the ion mirrors providing such an opposing electric field component, and the said electric field component causes the ions to reverse their direction and travel back towards the ion injector. The point of reversal occurs typically in the second portion of length of the ion mirrors. The ions may undergo an integer or a non-integer number of complete oscillations between the mirrors before returning to the vicinity of the ion injector. Preferably, the inclination angle of the ion beam to the X axis decreases with each reflection in the mirrors as the ions move along the drift direction away from the injector. Preferably, this continues until the inclination angle is reversed in direction and the ions return back along the drift direction towards the injector. The ion injector may comprise a pulsed ion injector, such as an ion trap, or an orthogonal accelerator, MALDI source, or other known ion injection means for a TOF mass spectrometer. Preferably, the ion injector comprises a pulsed ion trap, more preferably a linear ion trap and most preferably a curved linear ion trap (C-Trap). The ion injector, i.e. its centre, e.g. the centre of the ion trap from where ions can be injected into the mirror structure, is preferably located at the Y=0 position. The detector is similarly preferably located at Y=0.

Preferably embodiments of the present invention further comprise a detector located in a region adjacent the ion injector. The ion detector may be positioned adjacent the ion injector, for example within a distance (centre to centre) of 50 mm, or within 40 mm or within 30 mm or within 20 mm of the ion injector. Preferably the ion detector is arranged to have a detection surface which is parallel to the drift direction Y, i.e. the detection surface is parallel to the Y axis. In some embodiments, the detector may have a degree of inclination to the Y direction, preferably by an amount to match the angle of the ion isochronous plane, for example a degree of inclination of 1 to 5 degrees, or 1 to 4 degrees, or 1 to 3 degrees.

The multi-reflection mass spectrometer may form all or part of a multi-reflection time-of-flight mass spectrometer. In such embodiments of the invention, preferably the ion detector located in a region adjacent the ion injector is arranged to have a detection surface which is parallel to the drift direction Y, i.e. the detection surface is parallel to the Y axis. Preferably the ion detector is arranged so that ions that have traversed the mass spectrometer, moving forth and back along the drift direction as described above, impinge upon the ion detection surface and are detected. The ions may undergo an integer or a non-integer number of complete oscillations between the mirrors before impinging upon a detector. The ions preferably undergo only one oscillation in the drift direction in order that the ions do not follow the same path more than once so that there is no overlap of ions of different m/z, thus allowing full mass range analysis. However if a reduced mass range of ions is desired or is acceptable, more than one oscillation in the drift direction may be made between the time of injection and the time of detection of ions, further increasing the flight path length.

Additional detectors may be located within the multi-reflection mass spectrometer, with or without additional ion beam deflectors. Additional ion beam deflectors may be used to deflect ions onto one or more additional detectors, or alternatively additional detectors may comprise partially transmitting surfaces such as diaphragms or grids so as to detect a portion of an ion beam whilst allowing a remaining portion to pass on. Additional detectors may be used for beam monitoring in order to detect the spatial location of ions within the spectrometer, or to measure the quantity of ions passing through the spectrometer, for example. This can be employed for gain control of the final detector, for example. Hence more than one detector may be used to detect at least some of the ions during or after their passage through the mass spectrometer.

The multi-reflection mass spectrometer may form all or part of a multi-reflection electrostatic trap mass spectrometer, as will be further described. In such embodiments of the invention, the detector located in a region adjacent the ion injector preferably comprises one or more electrodes arranged to be close to the ion beam as it passes by, but located so as not to intercept it, the detection electrodes connected to a sensitive amplifier enabling the image current induced in the detection electrodes to be measured.

Advantageously, embodiments of the present invention may be constructed without the inclusion of any additional lenses or diaphragms in the region between the opposing ion optical mirrors. However additional lenses or diaphragms might be used with the present invention in order to affect the phase-space volume of ions within the mass spectrometer and embodiments are conceived comprising one or more lenses and diaphragms located in the space between the mirrors.

Preferably the multi-reflection mass spectrometer further comprises compensation electrodes, extending along at least a portion of the drift direction in or adjacent the space between the mirrors. Compensation electrodes allow further advantages to be provided, in particular in some embodiments that of reducing time-of-flight aberrations. Suitable compensation electrode designs are described in US2015/0028197 A1, the contents of which is hereby incorporated in its entirety by reference.

In some embodiments of the present invention, compensation electrodes are used with the opposing ion optical mirrors elongated generally along the drift direction. Preferably, the compensation electrodes create components of electric field which oppose ion motion along the +Y direction along at least a portion of the ion optical mirror lengths in the drift direction. These components of electric field preferably provide or contribute to a returning force upon the ions as they move along the drift direction.

The one or more compensation electrodes may be of any shape and size relative to the mirrors of the multi-reflection mass spectrometer. In preferred embodiments the one or more compensation electrodes comprise extended surfaces parallel to the X-Y plane facing the ion beam, the electrodes being displaced in +/−Z from the ion beam flight path, i.e. each one or more electrodes preferably having a surface substantially parallel to the X-Y plane, and where there are two such electrodes, preferably being located either side of a space extending between the opposing mirrors. In another preferred embodiment, the one or more compensation electrodes are elongated in the Y direction along a substantial portion of the drift length, each electrode being located either side of the space extending between the opposing mirrors. In this embodiment preferably the one or more compensation electrodes are elongated in the Y direction along a substantial portion, the substantial portion being at least one or more of: 1/10; 1/5; 1/4; 1/3; 1/2; 3/4 of the total drift length. Preferably the one or more compensation electrodes comprise two compensation electrodes elongated in the Y direction along a substantial portion of the drift length, the substantial portion being at least one or more of: 1/10; 1/5; 1/4; 1/3; 1/2; 3/4 of the total drift length, one electrode displaced in the +Z direction from the ion beam flight path, the other electrode displaced in the −Z direction from the ion beam flight path, the two electrodes thereby being located either side of a space extending between the opposing mirrors. However other geometries are anticipated. The one or more compensation electrodes can be elongated in the Y direction along substantially the first and second portions of the length along direction Y (i.e. along both stages of the different mirror convergence), or for example substantially along only the second portion of the length. Preferably, the compensation electrodes are electrically biased in use such that the total time of flight of ions is substantially independent of the incidence angle of the ions. As the total drift length traveled by the ions is dependent upon the incidence angle of the ions, the total time of flight of ions is substantially independent of the drift length traveled.

Compensation electrodes may be biased with an electrical potential. Where a pair of compensation electrodes is used, each electrode of the pair may have the same electrical potential applied to it, or the two electrodes may have differing electrical potentials applied. Preferably where there are two electrodes, the electrodes are located symmetrically either side of a space extending between the opposing mirrors and the electrodes are both electrically biased with substantially equal potentials.

In some embodiments, one or more pairs of compensation electrodes may have each electrode in the pair biased with the same electrical potential and that electrical potential may be zero volts with respect to what is herein termed as an analyser reference potential. Typically the analyser reference potential will be ground potential, but it will be appreciated that the analyser may be arbitrarily raised in potential, i.e. the whole analyser may be floated up or down in potential with respect to ground. As used herein, zero potential or zero volts is used to denote a zero potential difference with respect to the analyser reference potential and the term non-zero potential is used to denote a non-zero potential difference with respect to the analyser reference potential. Typically the analyser reference potential is, for example, applied to shielding such as electrodes used to terminate mirrors, and as herein defined is the potential in the drift space between the opposing ion optical mirrors in the absence of all other electrodes besides those comprising the mirrors.

In preferred embodiments, two or more pairs of opposing compensation electrodes are provided. In such embodiments, some pairs of compensation electrodes in which each electrode is electrically biased with zero volts are further referred to as unbiased compensation electrodes, and other pairs of compensation electrodes having non-zero electric potentials applied are further referred to as biased compensation electrodes. Preferably, where each of the biased compensation electrodes has a surface having a polynomial profile in the X-Y plane, the unbiased compensation electrodes have surfaces complimentarily shaped with respect to the biased compensation electrodes, examples of which will be further described. Typically the unbiased compensation electrodes terminate the fields from biased compensation electrodes. In a preferred embodiment, surfaces of at least one pair of compensation electrodes have a parabolic profile in the X-Y plane, such that the said surfaces extend towards each mirror a greater distance in the regions near one or both the ends of the mirrors than in the central region between the ends. In another preferred embodiment, at least one pair of compensation electrodes have surfaces having a polynomial profile in the X-Y plane, more preferably a parabolic profile in the X-Y plane, such that the said surfaces extend towards each mirror a lesser distance in the regions near one or both the ends of the mirrors than in the central region between the ends. In such embodiments preferably the pair(s) of compensation electrodes extend along the drift direction Y from a region adjacent an ion injector at one end of the elongated mirrors, and the compensation electrodes are substantially the same length in the drift direction as the extended mirrors, and are located either side of a space between the mirrors. In alternative embodiments, the compensation electrode surfaces as just described may be made up of multiple discrete electrodes.

In other embodiments, compensation electrodes may be located partially or completely within the space extending between the opposing mirrors, the compensation electrodes comprising a set of separate tubes or compartments. Preferably the tubes or compartments are centred upon the X-Y plane and are located along the drift length so that ions pass through the tubes or compartments and do not impinge upon them. The tubes or compartments preferably have different lengths at different locations along the drift length, and/or have different electrical potentials applied as a function of their location along the drift length.

Preferably, in all embodiments of the present invention, the compensation electrodes do not comprise ion optical mirrors in which the ion beam encounters a potential barrier at least as large as the kinetic energy of the ions in the drift direction. However, as has already been stated and will be further described, they preferably create components of electric field which oppose ion motion along the +Y direction along at least a portion of the ion optical mirror lengths in the drift direction.

Preferably the one or more compensation electrodes are, in use, electrically biased so as to compensate for at least some of the time-of-flight aberrations generated by the opposing mirrors. Where there is more than one compensation electrode, the compensation electrodes may be biased with the same electrical potential, or they may be biased with different electrical potentials. Where there is more than one compensation electrode one or more of the compensation electrodes may be biased with a non-zero electrical potential whilst other compensation electrodes may be held at another electrical potential, which may be zero potential. In use, some compensation electrodes may serve the purpose of limiting the spatial extent of the electric field of other compensation electrodes. Preferably where there is a first pair of opposing compensation electrodes spaced either side of the beam flight path between the mirrors of the multi-reflection mass spectrometer, the first pair of compensation electrodes will be electrically biased with the same non-zero potential, and, the multi-reflection mass spectrometer further preferably comprises two additional pairs of compensation electrodes, which are located either side of the first pair of compensation electrodes in +/−X directions, the further pairs of compensation electrodes being held at zero potential, i.e. being unbiased compensation electrodes. In another preferred embodiment, three pairs of compensation electrodes are utilised, with a first pair of unbiased compensation electrodes held at zero potential and either side of these compensation electrodes in +/−X directions two further pairs of biased compensation electrodes held at a non-zero electrical potential. In some embodiments, one or more compensation electrodes may comprise a plate coated with an electrically resistive material which has different electrical potentials applied to it at different ends of the plate in the Y direction, thereby creating an electrode having a surface with a varying electrical potential across it as a function of the drift direction Y. Accordingly, electrically biased compensation electrodes may be held at no one single potential. Preferably the one or more compensation electrodes are, in use, electrically biased so as to compensate for a time-of-flight shift in the drift direction generated by the opposing mirrors and so as to make a total time-of-flight shift of the system substantially independent of an initial ion beam trajectory inclination angle in the X-Y plane, as will be further described. The electrical potentials applied to compensation electrodes may be held constant or may be varied in time. Preferably the potentials applied to the compensation electrodes are held constant in time whilst ions propagate through the multi-reflection mass spectrometer. The electrical bias applied to the compensation electrodes may be such as to cause ions passing in the vicinity of a compensation electrode so biased to decelerate, or to accelerate, the shapes of the compensation electrodes differing accordingly, examples of which will be further described.

As herein described, the term "width" as applied to compensation electrodes refers to the physical dimension of the biased compensation electrode in the +/−X direction.

Preferably, the compensation electrodes are so configured and biased in use to create one or more regions in which an electric field component in the Y direction is created which opposes the motion of the ions along the +Y drift direction. The compensation electrodes thereby cause the ions to lose velocity in the drift direction as they proceed along the drift length in the +Y direction and the configuration of the compensation electrodes and biasing of the compensation electrodes is arranged to cause the ions to turn around in the drift direction before reaching the end of the mirrors and return back towards the ion injection region. Advantageously this is achieved without sectioning the opposing mirrors and without introducing a third mirror. Preferably the ions are brought to a spatial focus in the region of the ion injector where a suitable detection surface is arranged, as described for other embodiments of the invention. Preferably the electric field in the Y direction creates a force which opposes the motion of ions linearly as a function of distance in the drift direction (a quadratic opposing electrical potential) as will be further described.

It will be appreciated that potentials (i.e. electric potentials) and electric fields provided by the ion mirrors and/or potentials and electric fields provided by the compensation electrodes are present when the ion mirrors and/or compensation electrodes respectively are electrically biased.

Preferably, methods of mass spectrometry using the present invention further comprise injecting ions into a multi-reflection mass spectrometer comprising compensation electrodes, extending along at least a portion of the drift direction in or adjacent the space between the mirrors. Preferably the ions are injected from an ion injector located at one end of the opposing mirrors in the drift direction and in some embodiments ions are detected by impinging upon a detector located in a region in the vicinity of the ion injector, e.g. adjacent thereto. In other embodiments ions are detected by image current detection means, as described above. The mass spectrometer to be used in the method of the present invention may further comprise components with details as described above.

In use, ions are reflected between the ion optical mirrors whilst proceeding a distance along the drift direction between reflections, the ions reflecting a plurality of times, and the said distance varies as a function of the ions' position along at least part of the drift direction. The ion-optical arrangement may further comprise one or more compensation electrodes each electrode being located in or adjacent the space extending between the opposing mirrors, the compensation electrodes being arranged and electrically biased in use so as to produce, in the X-Y plane, an electrical potential offset (preferably providing a return pseudo potential) which: (i) varies as a function of the distance along the drift length along at least a portion of the drift length, and/or; (ii) has a different extent in the X direction as a function of the distance along the drift length along at least a portion of the drift length.

In some preferred embodiments which will be further described, the ion beam velocity is changed in such a way that all time-of-flight aberrations caused by non-parallel opposing ion optical mirrors are corrected. In such embodiments it is found that the change of the oscillation period resulting from a varying distance between the mirrors along the drift length is completely compensated by the change of the oscillation period resulting from the electrically biased compensation electrodes, in which case ions undergo a substantially equal oscillation time on each oscillation between the opposing ion-optical mirrors at all locations along the drift length even though the distance between the mirrors changes along the drift length. In other preferred embodiments of the invention the electrically biased compensation electrodes correct substantially the oscillation period so that the time-of-flight aberrations caused by non-parallel opposing ion optical mirrors are substantially compensated and only after a certain number of oscillations when the ions reach the plane of detection. It will be appreciated that for these embodiments, in the absence of the electrically biased compensation electrodes, the ion oscillation period between the opposing ion-optical mirrors would not be substantially constant, but would reduce as the ions travel along portions of the drift length in which the opposing mirrors are closer together.

Accordingly, the present invention further provides a method of mass spectrometry comprising the steps of injecting ions into an injection region of a multi-reflection mass spectrometer comprising two ion-optical mirrors opposing each other in an X direction and having a space therebetween, each mirror elongated generally along a drift direction Y, the X direction being orthogonal to Y, so that the ions oscillate between the opposing mirrors whilst proceeding along a drift length in the Y direction; wherein along a first portion of their length in the drift direction Y the ion mirrors converge with a first degree of convergence and along a second portion of their length in the drift direction Y the ion mirrors converge with a second degree of convergence, the first portion of their length being closer to the injection region than the second portion and the first degree of convergence being greater than the second degree of convergence, the spectrometer further comprising one or more compensation electrodes each electrode being located in or adjacent the space extending between the opposing mirrors, the compensation electrodes being, in use, electrically biased such that the period of ion oscillation between the mirrors is substantially constant along the whole of the drift length; and detecting at least some of the ions during or after their passage through the mass spectrometer. The ions are repeatedly reflected back and forth between the mirrors, i.e. in direction X, whilst they drift down the general direction of elongation, i.e. the direction Y. Also provided by the invention is a method of mass spectrometry comprising injecting ions from an ion injector into a space between two opposing ion mirrors of a multi-reflection mass spectrometer, wherein the ions are repeatedly reflected back and forth between the mirrors whilst they drift down a general direction of elongation, and detecting at least some of the ions during or after their passage through the mass spectrometer, the two ion mirrors opposing each other in an X direction, each mirror elongated generally along a drift direction Y, the X direction being orthogonal to the drift direction Y, wherein along a first portion of their length in the drift direction Y the ion mirrors converge with a first degree of convergence and along a second portion of their length in the drift direction Y the ion mirrors converge with a second degree of convergence or are parallel, the first portion of their length being closer to the ion injector than the second portion and the first degree of convergence being greater than the second degree of convergence.

Further provided by the invention is a method of mass spectrometry comprising injecting ions from an ion injector into a space between two opposing ion mirrors of a multi-reflection mass spectrometer, wherein the ions are repeatedly reflected back and forth between the mirrors whilst they drift down a general direction of elongation, and detecting at least some of the ions during or after their passage through the mass spectrometer, the two ion mirrors opposing each other in an X direction, each mirror elongated generally along a drift direction Y, the X direction being orthogonal to the drift direction Y, wherein at least one of the ion mirrors along a first portion of its length in the drift direction Y has a first non-zero angle of inclination to the direction Y and along a second portion of its length in the drift direction Y has a second non-zero angle of inclination to the direction Y that is less than the first non-zero angle of inclination to the direction Y or has zero angle of inclination to the direction Y, the first portion of length being closer to the ion injector than the second portion.

Still further provided by the invention is a method of mass spectrometry comprising injecting ions from an ion injector into a space between two opposing ion mirrors of a multi-reflection mass spectrometer, wherein the ions are repeatedly reflected back and forth between the mirrors whilst they drift down a general direction of elongation, and detecting at least some of the ions during or after their passage through the mass spectrometer, the two ion mirrors opposing each other in an X direction, each mirror elongated generally along a drift direction Y, the X direction being orthogonal to the drift direction Y, wherein the ion mirrors along a first portion of their length in the drift direction Y provide a first return pseudo-potential gradient for reducing the ion drift velocity in the drift direction Y, and the ion mirrors along a second portion of their length in the drift direction Y provide a second return pseudo-potential gradient for reducing the ion drift velocity in the drift direction Y or along the second portion of their length do not provide a return pseudo-potential, wherein the first return pseudo-potential gradient is greater than the second return pseudo-potential gradient and the first portion of length is closer to the ion injector than the second portion.

Still further provided by the invention is a method of mass spectrometry comprising injecting ions from an ion injector into a space between two opposing ion mirrors of a multi-reflection mass spectrometer, wherein the ions are repeatedly reflected back and forth between the mirrors whilst they drift down a general direction of elongation, and detecting at least some of the ions during or after their passage through the mass spectrometer, the two ion mirrors opposing each other in an X direction, each mirror elongated generally along a drift direction Y, the X direction being orthogonal to the drift direction Y, wherein the ion mirrors along a first portion of their length in the drift direction Y provide a first return pseudo-potential gradient for reducing the ion drift velocity in the drift direction Y, and the ion mirrors along a second portion of their length in the drift direction Y provide a second return pseudo-potential gradient for reducing the ion drift velocity in the drift direction Y or along the second portion of their length do not provide a return pseudo-potential, wherein the first return pseudo-potential gradient is greater than the second return pseudo-potential gradient and the first portion of length is closer to the ion injector than the second portion.

The invention also provides a method of mass spectrometry comprising injecting ions from an ion injector into a space between two opposing ion mirrors of a multi-reflection mass spectrometer, wherein the ions are repeatedly reflected back and forth between the mirrors whilst they drift down a general direction of elongation, and detecting at least some of the ions during or after their passage through the mass spectrometer, the two ion mirrors opposing each other in an X direction, each mirror elongated generally along a drift direction Y, the X direction being orthogonal to the drift direction Y, wherein the ion mirrors along a first portion of their length in the drift direction Y provide a first rate of deceleration of the ion drift velocity in the drift direction Y, and the ion mirrors along a second portion of their length in the drift direction Y provide a second rate of deceleration of the ion drift velocity in the drift direction Y or along the second portion of their length do not provide a deceleration of the ion drift velocity in the drift direction Y, wherein the first rate of deceleration of the ion drift velocity is greater than the second rate of deceleration of the ion drift velocity and the first portion of length is closer to the ion injector than the second portion.

The present invention further provides a multi-reflection mass spectrometer comprising two ion-optical mirrors opposing the other in an X direction and having a space therebetween, each mirror elongated generally along a drift direction Y, the X direction being orthogonal to Y, wherein along a first portion of their length in the drift direction Y the ion mirrors converge with a first degree of convergence and along a second portion of their length in the drift direction Y the ion mirrors converge with a second degree of convergence, the first degree of convergence being greater than the second degree of convergence, and further comprising an ion injector located at one end of the ion-optical mirrors closer to the first portion of their length and arranged so that in use it injects ions such that they oscillate between the opposing mirrors whilst proceeding along a drift length in the Y direction; the spectrometer further comprising one or more compensation electrodes each electrode being located in or adjacent the space extending between the opposing mirrors, the compensation electrodes being, in use, electrically biased such that the period of ion oscillation between the mirrors is substantially constant along the whole of the drift length.

The present invention still further provides a multi-reflection mass spectrometer comprising two ion-optical mirrors, each mirror elongated generally along a drift direction (Y), each mirror opposing the other in an X direction and having a space therebetween, the X direction being orthogonal to Y, and an ion injector located at one end of the ion-optical mirrors in the drift direction arranged so that in use it injects ions such that they oscillate between the opposing mirrors whilst proceeding along a drift length in the Y direction; wherein along a first portion of their length in the drift direction Y the ion mirrors converge with a first degree of convergence and along a second portion of their length in the drift direction Y the ion mirrors converge with a second degree of convergence, the first degree of convergence being greater than the second degree of convergence, the first portion of their length being closer to the ion injector than the second portion and wherein the amplitude of ion oscillation between the mirrors is not substantially constant along the whole of the drift length. Preferably the amplitude decreases along at least a portion of the drift length as ions proceed away from the ion injector. Preferably, the amplitude of ion oscillation decreases between the first portion of the length and the second portion of the length of the ion mirrors in the direction Y. Preferably the ions are turned around after passing along the drift length and proceed back along the drift length towards the ion injector. In certain embodiments, the distance between equipotential surfaces at which the ions turn in the +/−X direction is not substantially constant along the whole of the drift length.

In some embodiments of the invention, the distance between consecutive points in the X direction at which the ions turn monotonously changes with Y during at least a part of the motion of the ions along the drift direction; and at least some of the ions are detected during or after their passage through the mass spectrometer.

As already described, preferably one or more compensation electrodes are so configured and biased in use to create one or more regions in which an electric field component in the Y direction is created which opposes the motion of the ions along the +Y drift direction. The compensation electrodes preferably extend along at least a portion of the drift direction, each electrode being located in or adjacent the space extending between the opposing mirrors, the compensation electrodes being shaped and electrically biased in use so as to produce, in at least a portion of the space extending between the mirrors, an electrical potential offset which: (i) varies as a function of the distance along the drift length, and/or; (ii) has a different extent in the X direction as a function of the distance along the drift length. In these embodiments the compensation electrodes being so configured (i.e. shaped and arranged in space) and biased in use create one or more regions in which an electric field component in the Y direction is created which opposes the motion of the ions along the +Y drift direction. As the ions are repeatedly reflected from one ion optical mirror to the other and at the same time proceed along the drift length, the ions turn within each mirror. The distance between subsequent points at which the ions turn in the Y-direction changes monotonously with Y during at least a part of the motion of the ions along the drift direction, and the period of ion oscillation between the mirrors is not substantially constant along the whole of the drift length. The electrically biased compensation electrodes cause the ion velocity in the X direction (at least) to be altered along at least a portion of the drift length, and the period of the ion oscillation between the mirrors is thereby changed as a function of the at least a portion of the drift length. In such embodiments both mirrors are elongated along the drift direction and are arranged an equal distance apart in the X direction. In some embodiments both mirrors are elongated non-linearly along the drift direction and in other embodiments both mirrors are elongated linearly along the drift direction. Preferably for ease of manufacture both mirrors are elongated linearly along the drift direction, i.e. both mirrors are straight. In embodiments of the invention the period of ion oscillation decreases along at least a portion of the drift length as ions proceed away from the ion injector. Preferably the ions are turned around after passing along the drift length and proceed back along the drift length towards the ion injector. In embodiments of the present invention, compensation electrodes are used to alter the ion beam velocity and, therefore, the ion oscillation periods, as the ion beam passes near to a compensation electrode, or more preferably between a pair of compensation electrodes. The compensation electrodes thereby cause the ions to lose velocity in the drift direction and the configuration of the compensation electrodes and biasing of the compensation electrodes is arranged to preferably cause the ions to turn around in the drift direction before reaching the end of the mirrors and return back towards the ion injection region. Advantageously this is achieved without sectioning the opposing mirrors and without introducing a third mirror. Preferably the ions are brought to a spatial focus in the region of the ion injector where a suitable detection surface is arranged, as previously described for other embodiments of the invention. Preferably the electric field in the Y direction creates a force which opposes the motion of ions linearly as a function of distance in the drift direction (a quadratic opposing electrical potential) as will be further described.

The biased compensation electrodes located adjacent or in the space between the ion mirrors can be positioned between two or more unbiased (grounded) electrodes in the X-Y plane that are also located adjacent or in the space between the ion mirrors. The shapes of the unbiased electrodes can be complementary to the shape of the biased compensation electrodes.

In some preferred embodiments, the space between the opposing ion optical mirrors is open ended in the X-Z plane at each end of the drift length. By open ended in the X-Z plane it is meant that the mirrors are not bounded by electrodes in the X-Z plane which fully or substantially span the gap between the mirrors.

Embodiments of the multi-reflection mass spectrometer of the present invention may form all or part of a multi-reflection electrostatic trap mass spectrometer. A preferred electrostatic trap mass spectrometer comprises two multi-reflection mass spectrometers arranged end to end symmetrically about an X axis such that their respective drift directions are collinear, the multi-reflection mass spectrometers thereby defining a volume within which, in use, ions follow a closed path with isochronous properties in both the drift directions and in an ion flight direction. Such systems are described in US2015/0028197 and shown in FIG. 13 of that document, the disclosure of which is hereby incorporated by reference in its entirety (however, where anything in the incorporated reference contradicts anything stated in the present application, the present application prevails). A plurality of pairs (e.g. four pairs in the case of two multi-reflection mass spectrometers arranged end to end) of stripe-shaped detection electrodes can be used for readout of an induced-current signal on every pass of the ions between the mirrors. The electrodes in each pair are symmetrically separated in the Z-direction and can be located in the planes of compensation electrodes or closer to the ion beam. The electrode pairs are connected to the direct input of a differential amplifier and the electrode pairs are connected to the inverse input of the differential amplifier, thus providing differential induced-current signal, which advantageously reduces the noise. To obtain the mass spectrum, the induced-current signal is processed in known ways using the Fourier transform algorithms or specialized comb-sampling algorithm, as described by J. B. Greenwood at al. in Rev. Sci. Instr. 82, 043103 (2011).

The multi-reflection mass spectrometer of the present invention may form all or part of a multi-reflection time-of-flight mass spectrometer.

A composite mass spectrometer may be formed comprising two or more multi-reflection mass spectrometers according to the invention aligned so that the X-Y planes of each mass spectrometer are parallel and optionally displaced from one another in a perpendicular direction Z, the composite mass spectrometer further comprising ion-optical means to direct ions from one multi-reflection mass spectrometer to another. In one such embodiment of a composite mass spectrometer a set of multi-reflection mass spectrometers are stacked one upon another in the Z direction and ions are passed from a first multi-reflection mass spectrometer in the stack to further multi-reflection mass spectrometers in the stack by means of deflection means, such as electrostatic electrode deflectors, thereby providing an extended flight path composite mass spectrometer in which ions do not follow the same path more than once, allowing full mass range TOF analysis as there is no overlap of ions. Such systems are described in US2015/0028197 and shown in FIG. 14 of that document. In another such embodiment of a composite mass spectrometer a set of multi-reflection mass spectrometers are each arranged to lie in the same X-Y plane and ions are passed from a first multi-reflection mass spectrometer to further multi-reflection mass spectrometers by means of deflection means, such as electrostatic electrode deflectors, thereby providing an extended flight path composite mass spectrometer in which ions do not follow the same path more than once, allowing full mass range TOF analysis as there is no overlap of ions. Other arrangements of multi-reflection mass spectrometers are envisaged in which some of the spectrometers lie in the same X-Y plane and others are displaced in the perpendicular Z direction, with ion-optical means arranged to pass ions from spectrometer to another thereby providing an extended flight path composite mass spectrometer in which ions do not follow the same path more than once. Preferably, where some spectrometers are stacked in Z direction, the said spectrometers have alternating orientations of the drift directions to avoid the requirement for deflection means in the drift direction.

Alternatively, embodiments of the present invention may be used with a further beam deflection means arranged to turn ions around and pass them back through the multi-reflection mass spectrometer or composite mass spectrometer one or more times, thereby multiplying the flight path length, though at the expense of mass range.

Analysis systems for MS/MS may be provided using the present invention comprising a multi-reflection mass spectrometer and, an ion injector comprising an ion trapping device upstream of the mass spectrometer, and a pulsed ion gate, a high energy collision cell and a time-of-flight analyser downstream of the mass spectrometer. Moreover, the same analyser could be used for both stages of analysis or multiple such stages of analysis thereby providing the capability of $MS^n$, by configuring the collision cell so that ions emerging from the collision cell are directed back into the ion trapping device.

The present invention provides a multi-reflection mass spectrometer and method of mass spectrometry comprising opposing mirrors elongated along a drift direction and means to provide a returning force opposing ion motion along the drift direction. In the present invention the returning force is smoothly distributed along a portion of the drift direction, most preferably along substantially the whole of the drift direction, reducing or eliminating uncontrolled ion scattering especially near the turning point in the drift direction, for example in the second portion of the length, where the ion beam width is at its maximum. This smooth returning force is in some embodiments provided through the use of continuous, non-sectioned electrode structures present in the mirrors, the mirrors being inclined or curved to one another along at least a portion of the drift length, preferably most of the drift length. In particularly preferred embodiments the returning force is provided both by opposing ion optical mirrors being inclined or curved to one another at one end and by the use of biased compensation electrodes. Notably the returning force is not provided by a potential barrier at least as large as the ion beam kinetic energy in the drift direction.

In systems of two opposing elongated mirrors alone, the implementation of a returning force, by inclining the mirrors, will necessarily introduce time-of-flight aberrations dependent upon the initial ion beam injection angle, because the electric field in the vicinity of the returning force means cannot be represented simply by the sum of two terms, one being a term for the field in the drift direction ($E_y$) and one being a term for the field transverse to the drift direction ($E_x$). Substantial minimization of such aberrations is provided in the present invention by the use of compensation electrodes, accruing a further advantage to such embodiments.

The time-of-flight aberrations of some embodiments of the present invention can be considered as follows, in relation to a pair of opposing ion optical mirrors elongated in their lengths along a drift direction Y and which are progressively inclined closer together in the X direction along at least a portion of their lengths. An initial pulse of ions entering the mirror system will comprise ions having a range of injection angles in the X-Y plane. A set of ions having a larger Y velocity will proceed down the drift length a little further at each oscillation between the mirrors than a set of ions with a lower Y velocity. The two sets of ions will have a different oscillation time between the mirrors because the mirrors are inclined to one another by a differing amount as a function of the drift length. In preferred embodiments the mirrors are closer together at a distal end from the ion injection means. The ions with higher Y velocity will encounter a pair of mirrors with slightly smaller gap between them than will the ions having lower Y velocity, on each oscillation within the portion of the mirrors which has mirror inclination. This may be compensated for by the use of one or more compensation electrodes. To illustrate this, a pair of compensation electrodes will be considered (as a non-limiting example), extending along the drift direction adjacent the space between the mirrors, comprising extended surfaces in the X-Y plane facing the ion beam, each electrode located either side of a space extending between the opposing mirrors. Suitable electrical biasing of both electrodes by, for example, a positive potential, will provide a region of space between the mirrors in which positive ions will proceed at lower velocity. If the biased compensation electrodes are arranged so that the extent of the region of space between them in the X direction varies as a function of Y then the difference in the oscillation time between the mirrors for ions of differing Y velocity may be compensated. Various means for providing that the region of space in the X direction varies as a function of Y may be contemplated, including: (a) using biased compensation electrodes shaped so that they extend in the +/−X directions a differing amount as a function of Y (i.e. they present a varying width in X as they extend in Y), or (b) using compensation electrodes that are spaced apart from one another a differing amount in Z as a function of Y. Alternatively, the amount of velocity reduction may be varied as a function of Y, by using, for example, using constant width compensation electrodes, each biased with a voltage which varies along their length as a function of Y and again the difference in the oscillation time between the mirrors for ions of differing Y velocity may thereby be compensated. Of course a combination of these means may also be used, and other methods may also be found, including for example, the use of additional electrodes with different electrical biasing, spaced along the drift length. The compensation electrodes, examples of which will be further described in detail, compensate at least partially for time-of-flight aberrations relating to the beam injection angular spread in the X-Y plane. Preferably the compensation electrodes compensate for time-of-flight aberrations relating to the beam injection angular spread in the X-Y plane to first order, and more preferably to second or higher order.

Advantageously, aspects of the present invention allow the number of ion oscillations within the mirrors structure and thereby the total flight path length to be altered by changing the ion injection angle, especially by the greater degree of convergence of the mirrors in the first portion of the length along direction Y. In some preferred embodiments biasing of the compensation electrodes is changeable in order to preserve the time-of-flight aberration correction for different number of oscillations as will be further described.

In embodiments of the present invention, the ion beam slowly diverges in the drift direction as the beam progresses towards the distal end of the mirrors from the ion injector, is reflected solely by means of a component of the electric field acting in the −Y direction which is produced by the opposing mirrors themselves and/or, where present, by the compensating electrodes, and the beam slowly converges again upon reaching the vicinity of the ion injector, where the ion detector may also be located. The ion beam is thereby spread out in space to some extent during most of this flight path and space charge interactions are thereby advantageously reduced.

Time-of-flight focusing is also provided by the non-parallel mirror arrangement of some embodiments of the invention together with suitably shaped compensation electrodes, as described earlier; time-of-flight focusing with respect to the spread of injection angles is provided by the non-parallel mirror arrangement of the invention and correspondingly shaped compensating electrodes. Time of flight focusing with respect to energy spread in the X direction is also provided by the special construction of the ion mirrors, generally known from the prior art and more fully described below. As a result of time-of-flight focussing in both X and Y directions, the ions arrive at substantially same coordinate in the Y direction in the vicinity of the ion injector and/or detector after a designated number of oscillations between the mirrors in X direction. Spatial focussing on the detector is thereby achieved without the use of additional focusing elements and the mass spectrometer construction is greatly simplified. The mirror structures may be continuous, i.e. not sectioned, and this eliminates ion beam scattering associated with the step-wise change in the electric field in the gaps between such sections, especially near the turning point in the drift direction where the ion beam width is at its maximum. It also enables a much simpler mechanical and electrical construction of the mirrors, providing a less complex analyser. Only two mirrors are required. Furthermore, in some embodiments of the invention the time-of-flight aberrations created due to the non-parallel opposing mirror structure may be largely eliminated by the use of compensation electrodes, enabling high mass resolving power to be achieved at a suitably placed detector. Many problems associated with prior art multi-reflecting mass analysers are thereby solved by the present invention.

In a further aspect of the present invention there is provided a method of injecting ions into a time-of-flight spectrometer or electrostatic trap according to the invention comprising the steps of: ejecting a substantially parallel beam of ions radially from an ion trap such as a storage multipole at an injection inclination angle with respect to the axis X and reflecting the beam of ions in a first mirror at a point of reflection in the first portion of length of the mirror. As a result, the reflected beam of ions from the reflection in the first portion of length of the mirror has a first reduced inclination angle to the axis X compared to the injection inclination. The present invention further provides an ion injector apparatus for injecting ions into a time-of-flight spectrometer or electrostatic trap according to the invention comprising: an ion trap such as a storage multipole arranged to eject, in use, ions radially at an inclination angle with respect to the axis X so that the ions pass into the time-of-flight spectrometer to reflect in a first mirror at a point of reflection in the first portion of length of the mirror. Preferably the time-of-flight spectrometer is a mass spectrometer.

DETAILED DESCRIPTION

Various embodiments of the present invention will now be described by way of the following examples and the accompanying figures.

Figures 1A, 1B:
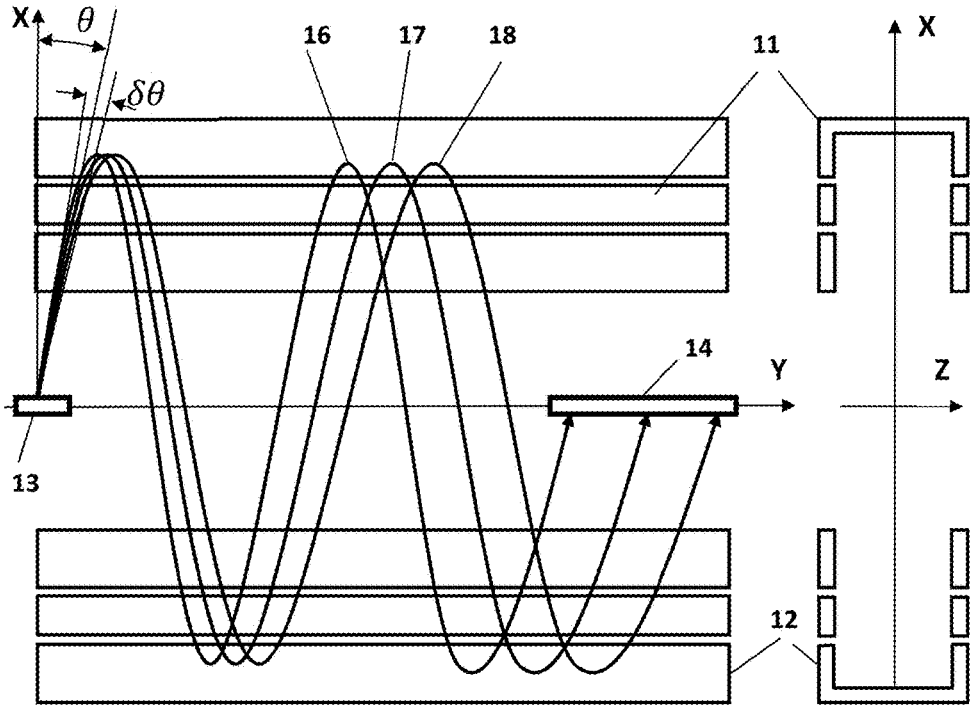
FIG. 1A and FIG. 1B are schematic diagrams of a multi-reflection mass spectrometer comprising two parallel ion-optical mirrors elongated linearly along a drift length, illustrative of prior art analysers, FIG. 1A in the X-Y plane, FIG. 1B in the X-Z plane.

FIG. 1A and FIG. 1B are schematic diagrams of a multi-reflection mass spectrometer comprising parallel ion-optical mirrors elongated linearly along a drift length, illustrative of prior art analysers. FIG. 1A shows the analyser in the X-Y plane and FIG. 1B shows the same analyser in the X-Z plane. Opposing ion-optical mirrors 11, 12 are elongated along a drift direction Y and are arranged parallel to one another. Ions are injected from ion injector 13 with angle θ to axis X and angular divergence δθ, in the X-Y plane. Accordingly, three ion flight paths are depicted, 16, 17, 18. The ions travel into mirror 11 and are turned around to proceed out of mirror 11 and towards mirror 12, whereupon they are reflected in mirror 12 and proceed back to mirror 11 following a zigzag ion flight path, drifting relatively slowly in the drift direction Y. After multiple reflections in mirrors 11, 12 the ions reach a detector 14, upon which they impinge, and are detected. In some prior art analysers the ion injector and detector are located outside the volume bounded by the mirrors. FIG. 1B is a schematic diagram of the multi-reflection mass spectrometer of FIG. 1A shown in section, i.e. in the X-Z plane, but with the ion flight paths 16, 17, 18, ion injector 13 and detector 14 omitted for clarity. Ion flight paths 16, 17, 18 illustrate the spreading of the ion beam as it progresses along the drift length in the case where there is no focusing in the drift direction. As previously described, various solutions including the provision of lenses in between the mirrors, periodic modulations in the mirror structures themselves and separate mirrors have been proposed to control beam divergence along the drift length. However it is advantageous to allow the ions to spread out as they travel along the drift length so as reduce space charge interactions, so long as they can be brought to some convergence where necessary to be fully detected.

Figure 2:
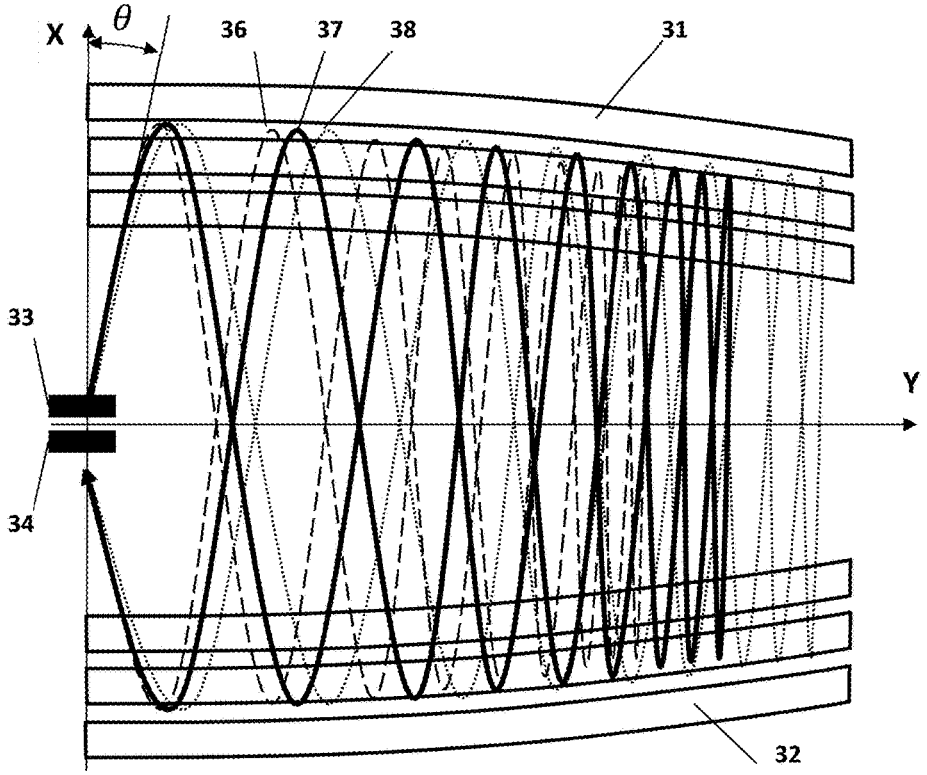
FIG. 2 is a schematic diagram of a multi-reflection mass spectrometer illustrative of further prior art analysers, comprising opposing ion-optical mirrors elongated parabolically along a drift length.

A preferred feature of the present invention is to provide an elongated opposing ion-mirror structure in which a smooth returning force is produced. FIG. 2 is a schematic diagram of a multi-reflection mass spectrometer described in US2015/0028197, comprising opposing ion-optical mirrors 31, 32 elongated generally along a drift length Y and having the shapes of parabolas converging towards each other in the distal end from the ion injector 33. This can be an arrangement for the second portion of length of the ion mirrors in the present invention. The disclosure of US2015/0028197 is hereby incorporated by reference in its entirety (however, where anything in the incorporated reference contradicts anything stated in the present application, the present application prevails). The injector 33 may be a conventional ion injector known in the art, for example an ion trap, orthogonal accelerator, MALDI ion source etc. Ions are accelerated by the acceleration voltage V and injected into the multi-reflection mass spectrometer from ion injector 33, at an angle θ in the X-Y plane and with an angular divergence δθ, in the same way as was described in relation to FIG. 1. Accordingly three ion flight paths 36, 37, 38 are representatively shown in FIG. 2. As already described, ions are reflected from one opposing mirror 31 to the other 32 a plurality of times whilst drifting along the drift direction away from the ion injector 33 so as to follow a generally zigzag paths within the mass spectrometer. The motion of ions along the drift direction is opposed by an electric field resulting from the non-constant distance of mirrors 31, 32 from each other along their lengths in the drift direction, and the said electric field causes the ions to reverse their direction and travel back towards the ion injector 33. Ion detector 34 is located in the vicinity of ion injector 33 and intercepts the ions. The ion paths 36, 37, 38 spread out along the drift length as they proceed from the ion injector due to the spread in angular divergence δθ as previously described in relation to FIG. 1A, but upon returning to the vicinity of the ion injector 33, the ion paths 36, 37, 38 have advantageously converged again and may conveniently be detected by ion-sensitive surface of detector 34 which is oriented orthogonal to the X axis.

The embodiment of FIG. 2 comprising opposing ion-optical mirrors 31, 32 is an example in which parabolic elongation of both mirrors is utilized. As already noted, in embodiments of the present invention the elongation may be linear (i.e. the mirrors are straight, possibly positioned at an angle towards each other), or the elongation may be non-linear (i.e. comprising curved mirrors), the elongation shape of each mirror may be the same or it may be different and any direction of elongation curvature may be the same or may be different. The mirrors may become closer together along the whole of the drift length, or along only a portion of the drift length, e.g. only at an injection end, or only at an injection end and a distal end (from the injector end), of the drift length of the mirrors.

After a pair of reflections in mirrors 31 and 32, the inclination angle changes by the value $\Delta\theta=2\times\Omega(Y)$, where $\Omega=L'(Y)$ is convergence angle of the mirrors with the effective distance L(Y) between them. This angle change is equivalent to the inclination angle change on the 2×L(0) flight distance in the effective returning potential $\Phi_m(Y)=2V[L(0)-L(Y)]/L(0)$. Parabolic elongation $L(Y)=L(0)-A\,Y^2$, where A is a positive coefficient, generates a quadratic distribution of the returning potential in which the ions advantageously take the same time to return to the point of their injection Y=0 independent of their initial drift velocity in the Y direction. The mirror convergence angle Ω(Y) is advantageously small and doesn't affect the isochronous properties of mirrors 31, 32 in the X direction as will be described further in relation to FIGS. 3 and 4. FIG. 2 is an example in which both an extended flight path length and spatial focusing of ions in the drift (Y) direction is accomplished by use of non-parallel mirrors. This embodiment advantageously needs no additional components to both double the drift length and induce spatial focusing—only two opposing mirrors are utilised. The use of opposing ion-optical mirrors elongated generally along the drift direction Y such that the mirrors are not a constant distance from each other along at least a portion of their lengths in the drift direction has produced these advantageous properties and these properties are achieved by alternative embodiments in which the mirrors are elongated linearly, for example. In this particular embodiment the opposing mirrors are curved towards each other with parabolic profiles as they elongate away from one end of the spectrometer adjacent an ion injector and this particular geometry further advantageously causes the ions to take the same time to return to their point of injection independent of their initial drift velocity.

Figure 3:
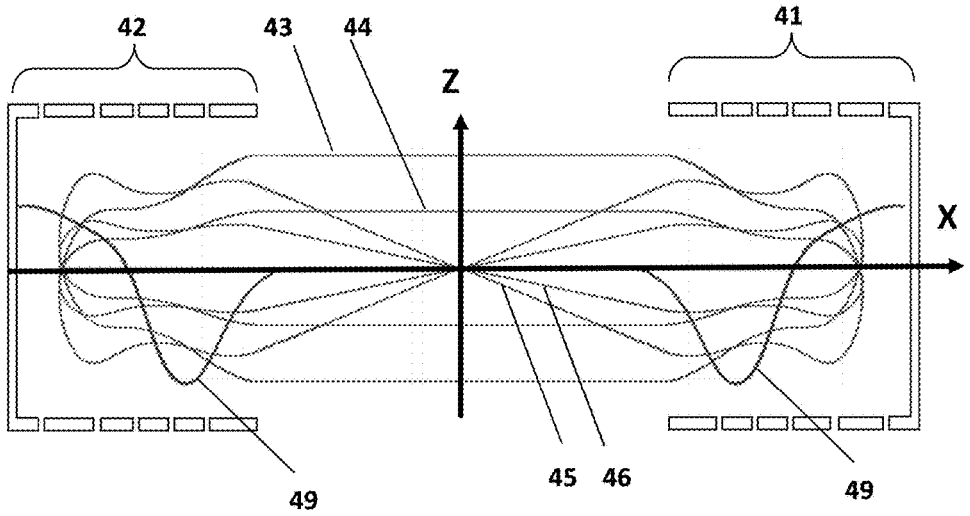
FIG. 3 is a schematic diagram of a section in the X-Z plane of an embodiment of multi-reflection mass spectrometer comprising two ion-mirrors, together with ion rays and potential plots.

FIG. 3 is a schematic diagram of a multi-reflection mass spectrometer comprising two preferred ion-mirrors 41, 42, together with ion rays 43, 44, 45, 46 and electrical potential distribution curves 49. Such ion mirrors can be employed with the present invention. Mirrors 41, 42 are shown in cross section, in the X-Z plane. Each mirror comprises a number of electrodes, and the electrode dimensions, positions and applied electrical voltages are optimized such that the oscillation time, T, of ions between the mirrors, is substantially independent of the ion energy, ε, in the interval $\varepsilon_0+/-(\Delta\varepsilon/2)$, where $\varepsilon_0=qV$ is the reference energy defined by the acceleration voltage V and the ion charge q. The ion charge is hereafter assumed positive without loss of generality of the invention's applicability to both positive and negative ions. Electrical potential distribution curve 49 illustrates that each mirror has an accelerating region to achieve spatial focusing of ion trajectories in the X-Z plane parallel (43, 44) to point (45, 46) after a first reflection, and from point to parallel after a second reflection, providing ion motion stability in the X-Z plane. Ions experience the accelerating potential region of the mirror twice on each reflection: once on entry and once on exiting the mirror. As is known from prior art, this type of spatial focussing also helps to eliminate some time-of-flight aberrations with respect to positional and angular spreads in the Z direction.

Figure 4:
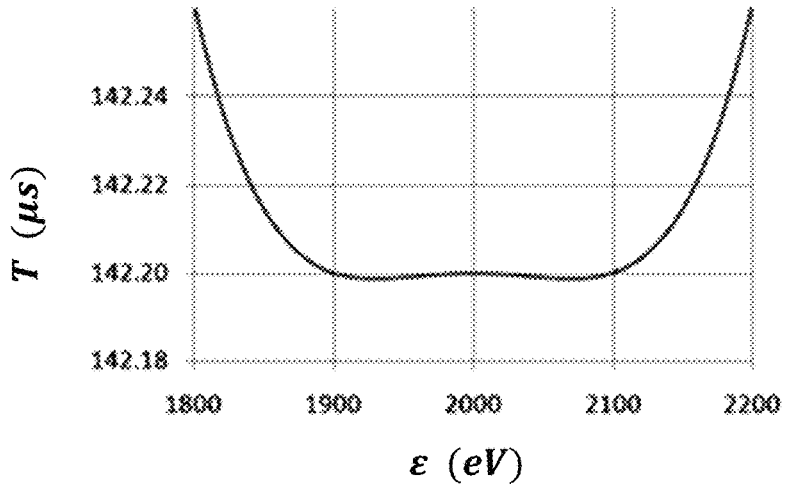
FIG. 4 is a graph of the oscillation time, T plotted against the beam energy, ε, calculated for mirrors of the type illustrated in FIG. 3.

As known from the prior art, mirrors of this design can produce highly isochronous oscillation time periods for ions with energy spreads $\Delta\varepsilon/\varepsilon_0>10\%$. FIG. 4 is a graph of the oscillation time, T plotted against the beam energy, ε, calculated for mirrors of the type illustrated in FIG. 3. It can be seen that a highly isochronous oscillation time period is achieved for ions of 2000 eV+/−100 eV. Gridless ion mirrors such as those illustrated in FIG. 3 could be implemented as described in U.S. Pat. No. 7,385,187 or WO2009/081143 using flat electrodes that could be fabricated by well-known technologies such as wire-erosion, electrochemical etching, jet-machining, electroforming, etc. They could be also implemented on printed circuit boards.

Figure 5A:
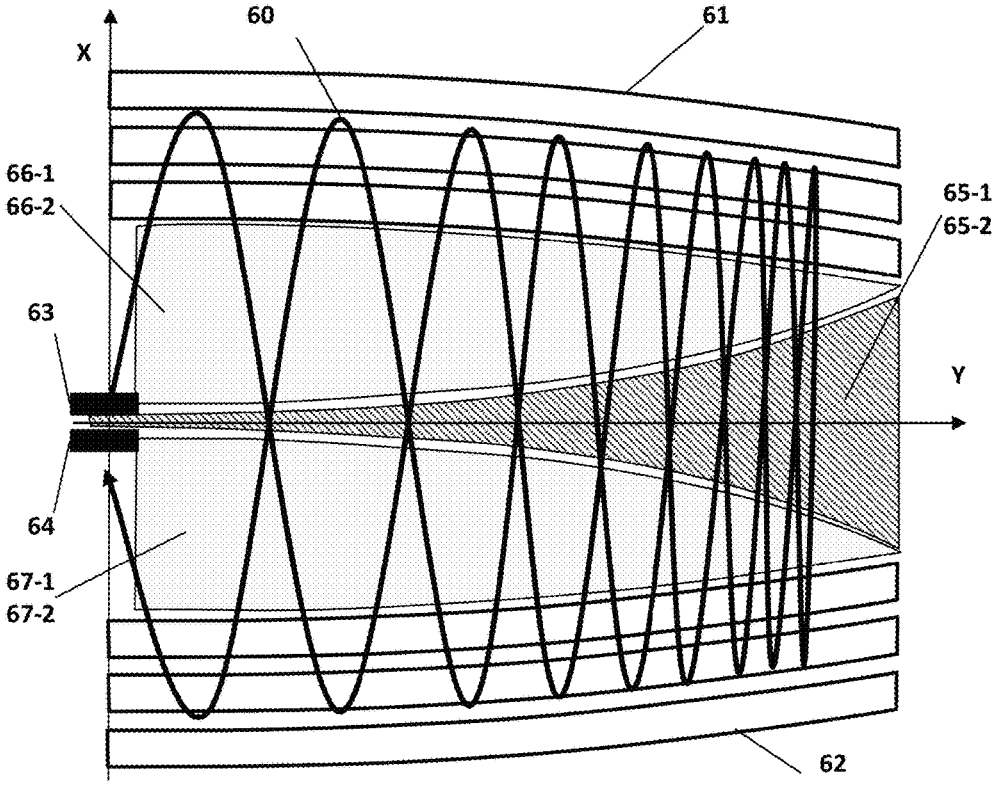
FIG. 5A is a schematic diagram of a multi-reflection mass spectrometer, comprising opposing ion-optical mirrors elongated parabolically along a drift length and further comprising parabolically shaped compensation electrodes, some of them biased with a positive voltage.
Figure 5B:
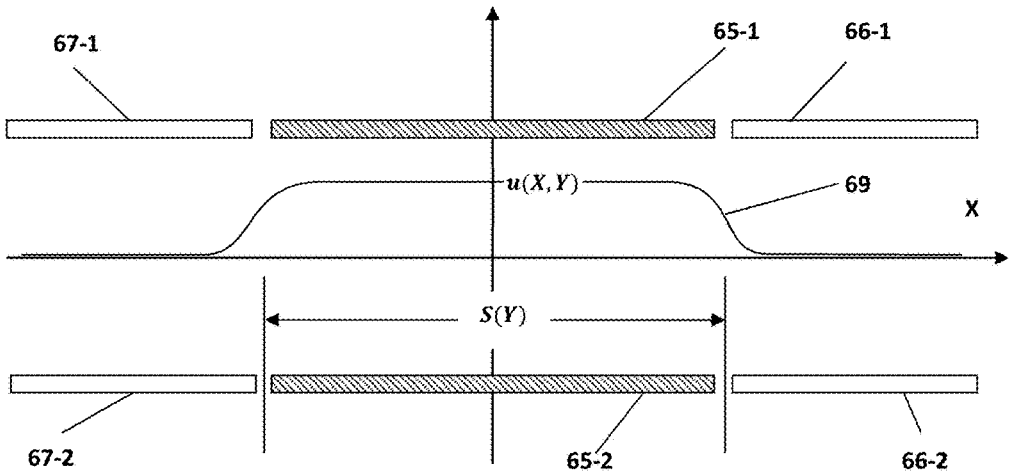
FIG. 5B is a schematic diagram of a section through the spectrometer of FIG. 5A.

FIG. 5A is a schematic diagram of a multi-reflection mass spectrometer described in US2015/0028197, comprising opposing ion-optical mirrors elongated parabolically along a drift length, further comprising compensation electrodes. Parabolically shaped ion mirrors and/or compensation electrodes can be employed with the present invention as described herein. In particular, this mirror system can be an arrangement for the second portion of length of the ion mirrors in the present invention. As a more technological implementation, parabolic shapes could be approximated by circular arcs (which could be then made on a turning machine). Compensation electrodes allow further advantages to be provided, in particular that of reducing time-of-flight aberrations. The embodiment of FIG. 5A is similar to that of FIG. 2, and similar considerations apply to the general ion motion from the injector 63 to the detector 64 the ions undergoing a plurality of oscillations 60 between mirrors 61, 62. As the ion beam approaches the distal end of mirrors 61, 62, the beam's angle of inclination in the X-Y plane gets progressively smaller until its sign is changed in the turning point and the ion beam starts its return path towards detector 64. The ion beam width in the Y dimension reaches its maximum near the turning point and the trajectories of ions having undergone different numbers of oscillations overlap thus helping to average out space charge effects. The ions come back to the detector 64 after a designated integer number of full oscillations between mirrors 61 and 62. Three pairs of compensation electrodes 65-1, 65-2 as one pair, 66-1, 66-2 as another pair and 67-1, 67-2 as a further pair, comprise extended surfaces in the X-Y plane facing the ion beam, the electrodes being displaced in +/−Z from the ion beam flight path, i.e. each compensation electrode 65-1, 66-1, 67-1, 65-2, 66-2, 67-2 has a surface substantially parallel to the X-Y plane located either side of a space extending between the opposing mirrors as shown in FIG. 5B. FIG. 5B is a schematic diagram showing a section through the mass spectrometer of FIG. 5A. In use, the compensation electrodes 65 are electrically biased, both electrodes having voltage offset U(Y)>0 applied in case of positive ions and U(Y)<0 applied in case of negative ions. Hereafter we assume the case of positive ions for this and the other embodiments if not stated otherwise. Voltage offset U(Y) is, in some embodiments, a function of Y, i.e. the potential of the compensation plates varies along the drift length, but in this embodiment the voltage offset is constant. The electrodes 66, 67 are not biased and have zero voltage offset. The compensation electrodes 65, 66, 67 have, in this example, a complex shape, extending in X direction a varying amount as a function of Y, the width of biased electrodes 65 in the X direction being represented by function S(Y). The shapes of unbiased electrodes 66 and 67 are complementary to the shape of biased electrodes 65. The extent of the compensation electrodes in the X direction is, in some embodiments, a width that is constant along the drift length, but in this embodiment the width varies as a function of the position along the drift length. The functions S(Y) and U(Y) are chosen to minimize the most important time-of-flight aberrations, as will be further described.

In use, the electrically biased compensation electrodes 65 generate potential distribution u(X, Y) in the plane of their symmetry Z=0, which is shown with schematic potential curve 69 in FIG. 5B. The potential distribution 69 is restricted spatially by the use of the unbiased compensation electrodes 66 and 67. The returning electric field $E_y=-\partial u/\partial Y$ makes the same change of the trajectory inclination angle as the effective potential distribution $\Phi_{ce}(Y)=L(0)^{-1}\int u(X,Y)\,dX\approx U(Y)S(Y)$ averaged over the effective distance between the mirrors L(0). The last approximate equality holds if the separation between the compensation electrodes in Z-direction is sufficiently small. In the embodiment shown in FIGS. 5A and 5B, the compensation electrodes are parabolic in shape, so that $S=B\,Y^2$, where B is a positive constant, and the voltage offset is constant $U=\text{const}\sim V\sin^2\theta \ll V$, where V is the accelerating voltage. (The accelerating voltage is with respect to the analyser reference potential.) Therefore, the set of compensation electrodes also generates a quadratic contribution to the effective returning potential, which, being additive with the same sign to the quadratic contribution of the parabolic mirrors, maintains the isochronous properties in drift direction. In embodiments with constant voltage offsets on biased compensation electrodes, the returning electric field $E_y$ is essentially non zero only near the edges of the compensation electrodes, which are non-parallel to the drift axis Y, and the ion trajectories thus undergo refraction every time they cross the edges.

The time-of-flight aberration of the embodiment in FIG. 5A results from two factors: the mirror convergence and the time delay of ions whilst travelling in between the compensation electrodes. When summed up, these two factors give the oscillation time $T(Y)=T(0)\times[L(Y)+S(Y)U/2V]/L(0)$ being a function of drift coordinate. In terms of components of the effective returning potential, $T(Y)-T(0)=T(0)\,[\Phi_{ce}(Y)-\Phi_m(Y)]/2V$. The coefficients A and B which define the parabolic shapes of the mirrors 61, 62 and the compensation electrodes 65, 66, 67, correspondingly, are preferably chosen in certain proportions to make the components of the returning force equal $\Phi_{ce}(Y)=\Phi_m(Y)$, so that the time per oscillation T(Y) is advantageously constant along the entire drift length and thus eliminates time-of-flight aberrations with respect to the initial angular spread. So, the decrease of the oscillation time at the position distant from the injection point due to the mirror convergence is completely compensated by decelerating the ions while travelling through the region between the compensating electrodes with increased electric potential. In this embodiment, both components of the effective potential contribute equally to the returning force that drives the ion beam back to the point of injection.

The embodiment in FIGS. 5A and 5B can be generalized by introduction of a polynomial representation of the effective returning potential components $\Phi_m=(V\sin^2\theta)\varphi_m$ and $\Phi_{ce}=(V\sin^2\theta)\varphi_{ce}$ where $\varphi_m=m_1y+m_2y^2$ and $\varphi_{ce}=c_0+c_1y+c_2y^2+c_3y^3+c_4y^4$ are dimensionless functions of dimensionless normalized drift coordinate $y=Y/Y_0^*$, and $Y_0^*$ is the designated drift penetration depth of an ion with mean acceleration voltage V and mean injection angle θ. Therefore, the sum of coefficients $m_1+m_2+c_1+c_2+c_3+c_4$ equals to 1 by definition. Consider an ion which reaches its turning point in drift direction $Y=Y_0$ that is a function of the ion's injection angle θ+Δθ defined by condition $\varphi_m(y_0)+\varphi_{ce}(y_0)-c_0=\sin^2(\theta+\Delta\theta)/\sin^2\theta$, where $y_0=Y_0/Y_0^*$ is the normalized turning point coordinate. The return time taken for this ion to come back to the injection point Y=0 is proportional to integral $$\tau(y_0)=\frac{2}{\pi}\int_0^{y_0}\frac{dy}{\sqrt{[\varphi_m(y_0)+\varphi_{ce}(y_0)]-[\varphi_m(y)+\varphi_{ce}(y)]}}$$

whilst the time-of-flight offset of the moment when an ion with given normalized turning point coordinate $y_0$ impinges the detector's plane X=0 after a designated number of oscillations between the mirrors is proportional to integral $$\sigma(y_0) = \frac{2}{\pi}\int_0^{y_0} \frac{\varphi_{ce}(y) - \varphi_m(y)}{\sqrt{[\varphi_m(y_0) + \varphi_{ce}(y_0)] - [\varphi_m(y) + \varphi_{ce}(y)]}}\,dy.$$

The deviation of function $\sigma(y_0)$ from $\sigma(1)$ thus determines the time-of-flight aberration with respect to the injection angle.

Figure 5C:
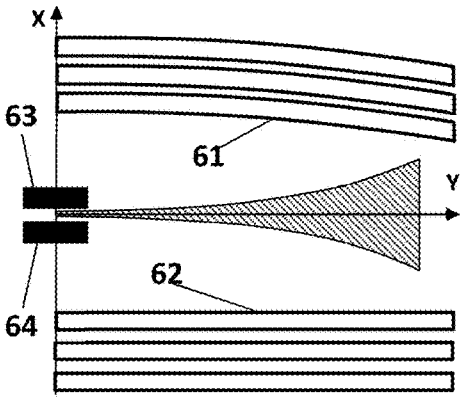
FIGS. 5C and 5D illustrate analogous embodiments with asymmetrical shapes of the mirrors.
Figure 5D:
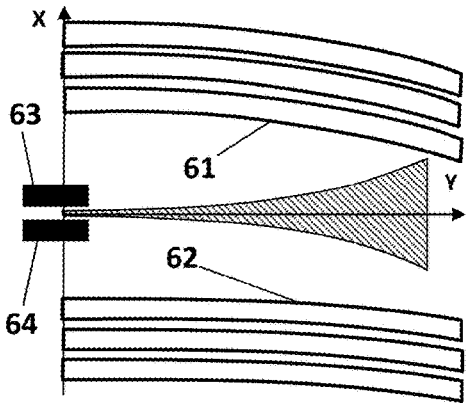

Values of the coefficients m and c are to be found from the following conditions: (1) the integral $\sigma$ is substantially constant (not necessarily zero) in the vicinity of $y_0=1$, which corresponds to slow time-of-flight dependence on the injection angle in the interval $\theta\pm\delta\theta/2$, and (2) the integral $\tau$ has vanishing derivative $\tau'$ (1) to ensure at least first-order spatial focusing of the ions on the detector. The embodiment represented schematically in FIG. 5A with parabolic mirrors and parabolic compensation electrodes corresponds to the values of coefficients m and c as in the first column in Table 1. Since the effective returning potential is quadratic, $\tau(y_0)\equiv 1$ and the ion beam is ideally spatially focused onto the detector. At the same time, $\sigma(y_0)\equiv 0$ which corresponds to complete compensation of the time-of-flight aberration with respect to the injection angle. Alternative embodiments may compromise these ideal properties for the sake of mirror fabrication feasibility. A preferred embodiment comprising only straight mirrors elongated along the drift direction and tilted towards each other with a small convergence angle $\Omega$ is a particular case, straight mirrors being more easily manufactured than curved mirrors (or even circular arcs). The embodiments with straight mirrors are characterized by linear dependence of the $\Phi_m$ component of the effective returning force, therefore the coefficients $m_1>0$ and $m_2=0$. Curved mirrors might be asymmetric as shown for example in FIG. 5C and FIG. 5D, with one mirror 62 being straight (FIG. 5C) or both mirrors may be curved in the same direction (FIG. 5D). In both cases, however, separation between the mirrors at the distal end is smaller than separation between the mirrors at the end next to the injector 63 and detector 64. These examples are only some of the possible mirror arrangements which may be utilised with the present invention for the second portion of the mirror length.

Figure 6A:
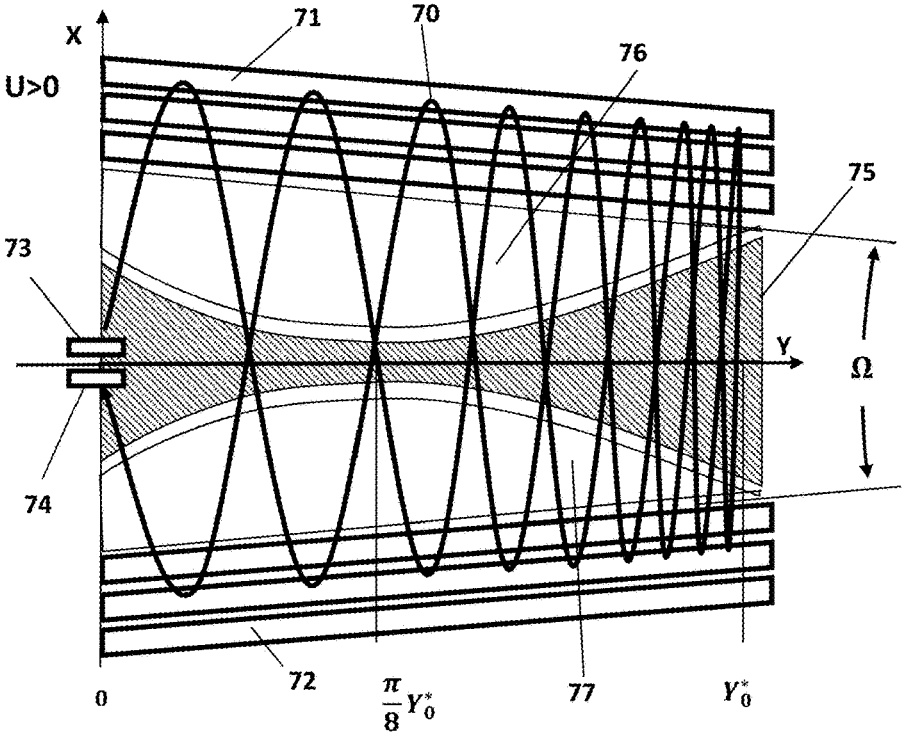
FIGS. 6A and 6B are schematic diagrams of multi-reflection mass spectrometers, comprising opposing ion-optical mirrors elongated linearly along a drift length and arranged at an inclined angle to one another, further comprising compensation electrodes with concave (FIG. 6A) and convex (FIG. 6B) parabolic shape.

FIG. 6A is a schematic diagram of a multi-reflection mass spectrometer described in US2015/0028197, comprising opposing straight ion-optical mirrors 71, 72 elongated along a drift length and tilted by small angle $\Omega$ towards each other. This can be an arrangement for the second portion of length of the ion mirrors in the present invention. The linear part of the total effective returning potential $\Phi=\Phi_m+\Phi_{ce}$ is zero because $m_1=-c_1$, and $\Phi$ is a quadratic function of the drift coordinate (save for the inessential constant resulting from $c_0$). Therefore exact spatial focusing of the ion beam 70 originating from injector 73, takes place on the detector 74. The value of coefficient $c_0$ may be an arbitrary positive value greater than $\pi^2/64$ to make the width function S(Y) of positively biased (in the case of positively charged ions) compensation electrodes 75 strictly positive along the drift length. The narrowest part of the biased compensation electrodes 75 is located at the distance $(\pi/8)\times Y_0^*$ from the point of ion injection. Two pairs of unbiased compensation electrodes 76 and 77 have their shapes complementary with the shapes of electrodes 75 and. serve to terminate the electric field from the biased compensation electrodes 75.

Figure 6B:
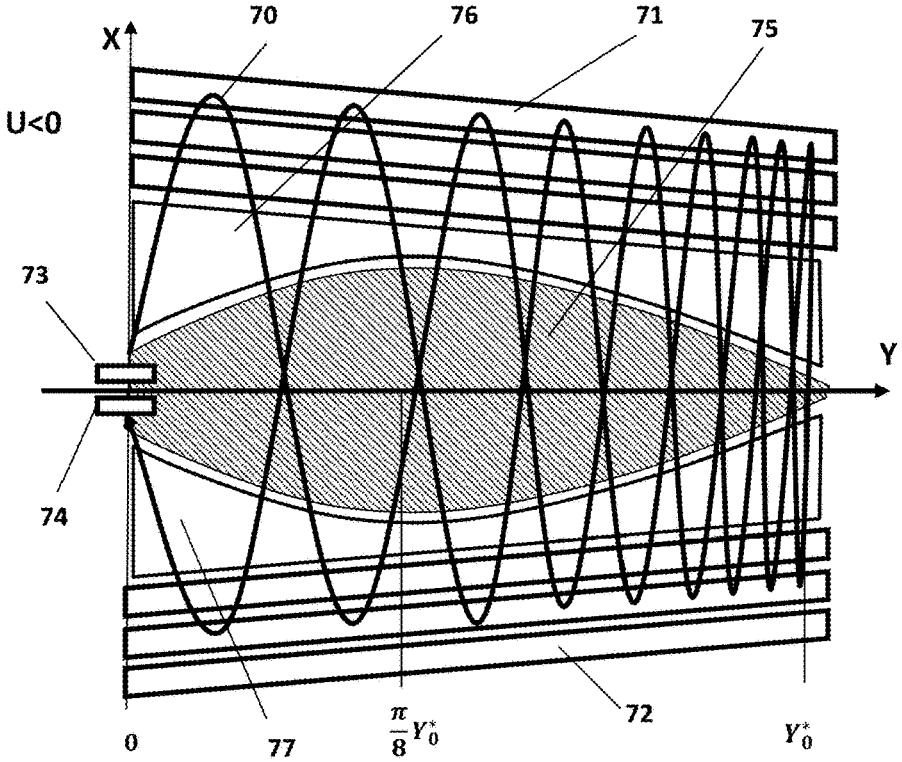

FIG. 6B is a schematic diagram of a multi-reflection mass spectrometer similar to that shown in FIG. 6A, with like components having like identifiers, but with negative offset U<0 on the biased compensating electrodes 75 (in case of positively charged ions). This can be an arrangement for the second portion of length of the ion mirrors in the present invention. It will be appreciated that for negative ions the polarities of the applied potentials will be opposite to those described here. The choice of coefficient $c_0<\pi/4-1$ makes the dimensionless function $\varphi_{ce}(y)<0$ along the whole drift length, so that the electrode width S(Y) is strictly positive. In this embodiment, the biased compensating electrodes 75 have convex parabolic shapes with their widest parts located at the distance $(\pi/8)\times Y_0^*$ from the point of ion injection.

The value of the mirror convergence angle is expressed through the coefficient $m_1=\pi/4$ with formula $\Omega=m_1L(0)\sin^2\theta/2Y_0^*$. With the effective distance between the mirrors L(0) being comparable with the drift distance $Y_0^*$ and the injection angle $\theta$=50 mrad, the mirror convergence angle can be estimated as $\Omega\approx 1$ mrad «0. Therefore, FIGS. 6A and 6B show the mirror convergence angle, and other features, not to scale.

Figure 6C:
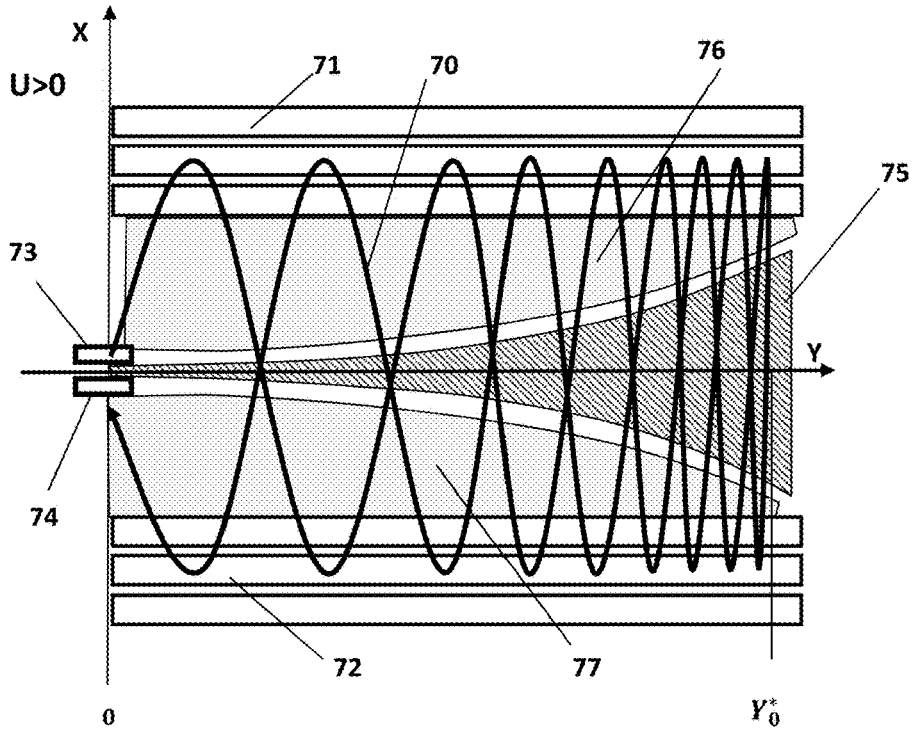
FIG. 6C is a schematic diagram of further multi-reflection mass spectrometer, comprising opposing ion-optical mirrors elongated linearly along a drift length and arranged parallel to one another, further comprising parabolic compensation electrodes.

FIG. 6C is a schematic diagram of a multi-reflection mass spectrometer similar to that shown in FIG. 6A, with like components having like identifiers, but with zero convergence angle, i.e. $\Omega=0$. This is an example of a mass spectrometer comprising two opposing ion-optical mirrors elongated generally along a drift direction (Y), each mirror opposing the other in an X direction and having a space therebetween, the X direction being orthogonal to Y, the mirrors being a constant distance from each other in the X direction along the whole of their lengths in the drift direction. This can be an arrangement for the second portion of length of the ion mirrors in the present invention. In this embodiment, the opposing mirrors are straight and arranged parallel to each other. Compensation electrodes similar to those already described in relation to FIG. 6A extend along the drift direction adjacent the space between the mirrors, each electrode having a surface substantially parallel to the X-Y plane, and being located either side of the space extending between the opposing mirrors, the compensation electrodes being arranged and biased in use so as to produce an electric potential offset having a different extent in the X direction as a function of the distance along the drift length (providing a return pseudopotential). The coefficient $c_2=1$ for this embodiment, and the other coefficients m and c vanish. The biased compensation electrodes produce a quadratic distribution of the total effective returning potential $\Phi(Y)=\Phi_{ce}(Y)$, therefore, exact spatial focusing of the ion beam 70 originating from injector 73, takes place on the detector 74. The value of coefficient $c_0$ may be an arbitrary positive value. Two additional pairs of unbiased compensation electrodes similar to electrodes 76 and 77, having their shapes complementary with the shape of biased compensation electrodes 75, serve to terminate the field from compensation electrodes 75. In this embodiment the compensation electrodes 75 are electrically biased to implement isochronous ion reflection in the drift direction; however, the time-of-flight aberrations with respect to the injection angle are not compensated.

In a similar manner, a multi-reflection mass spectrometer similar to that shown in FIG. 6B may be formed, but once again with zero convergence angle, i.e. $\Omega=0$. In this embodiment, biased compensating electrodes have convex parabolic shape with negative offset U<0 applied to implement isochronous ion reflection in the drift direction.

The present invention provides an improvement that can be utilised with the above described mirror arrangements and relates to high resolving power, along with the advantages in mass accuracy and sensitivity that come with it.

The resolving power of the spectrometers described in the prior art above is dependent upon the initial angle of ion injection, which determines the drift velocity and thus the overall time of flight. Ideally this injection angle would be minimised, but it can be restricted by the mechanical requirements of the injection apparatus and of the detector, especially for more compact designs. A solution presented in the prior art is to use an additional deflector positioned between the mirrors to reduce the drift velocity after ion injection, but this introduces some mechanical restrictions and time-of-flight aberrations of its own, and adds to the complexity and cost of the instrument.

Figure 7:
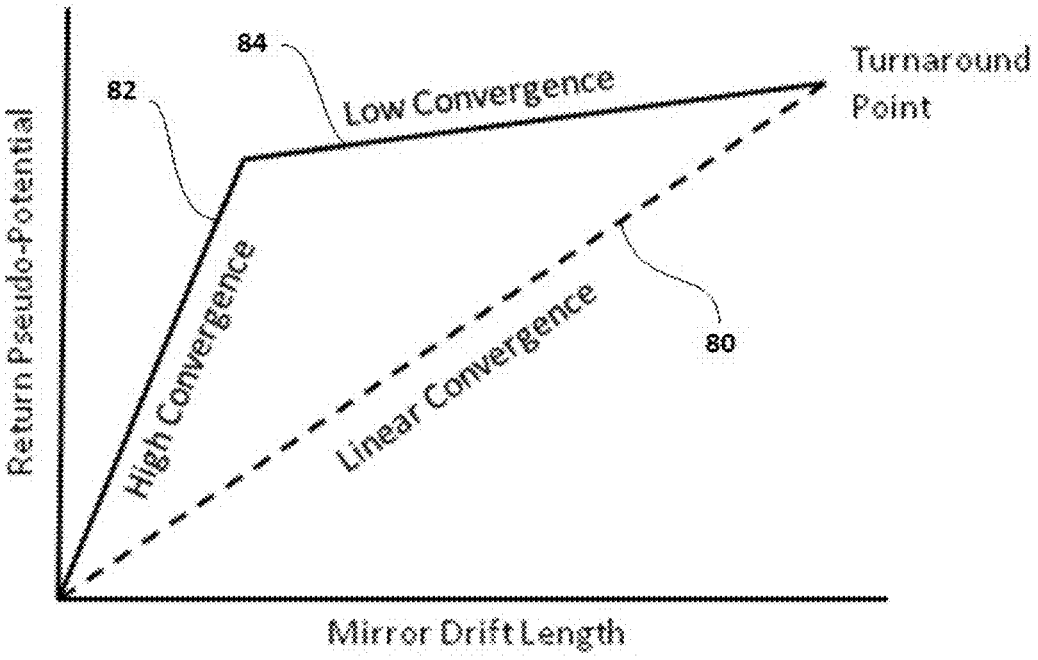
FIG. 7 is a graph showing a comparison of a two stage potential gradient of an embodiment of the invention with that of a simple, single-stage linear ramp of the prior art.

Embodiments of the present invention comprise reducing the post-injection drift velocity by modifying the return pseudo-potential generated by two converging mirrors. According to one type of embodiment, there is provided a first drift region of low displacement from the injector in the drift direction Y wherein the mirrors converge relatively more sharply (relatively higher convergence angle of the mirrors), followed by a second drift region of higher displacement from the injector in the drift direction Y wherein the mirrors converge relatively less sharply (relatively lower convergence angle of the mirrors compared to the first drift region), preferably wherein the convergence angle of the mirrors is substantially smaller in the second drift region than in the first drift region. Thus, the potential gradient is provided in two stages. A comparison of this two stage potential gradient with that of a simple, single-stage linear ramp is shown in FIG. 7, which plots the relationship between the return pseudo-potential provided to the ions by the mirrors (vertical axis) and mirror drift length (from the end of the mirrors closest to the ion injector) (horizontal axis). Line 80 represents the return pseudo-potential for the simple, single-stage linear ramp of the prior art. In contrast, line 82 represents the return pseudo-potential for the first drift region or first portion of mirror length, in which the mirrors converge sharply (giving a higher return pseudo-potential gradient). Further, the line 82 represents the return pseudo-potential for the second drift region or second portion of mirror length, in which the mirrors converge with much lower convergence angle (giving a lower return pseudo-potential gradient). The ion drift velocity is consequently more rapidly reduced in the first drift region (i.e. in a first portion of mirror length along Y), allowing increased time of flight through the second drift region (i.e. in a second portion of mirror length along Y) and overall increased flight path.

Figure 8:
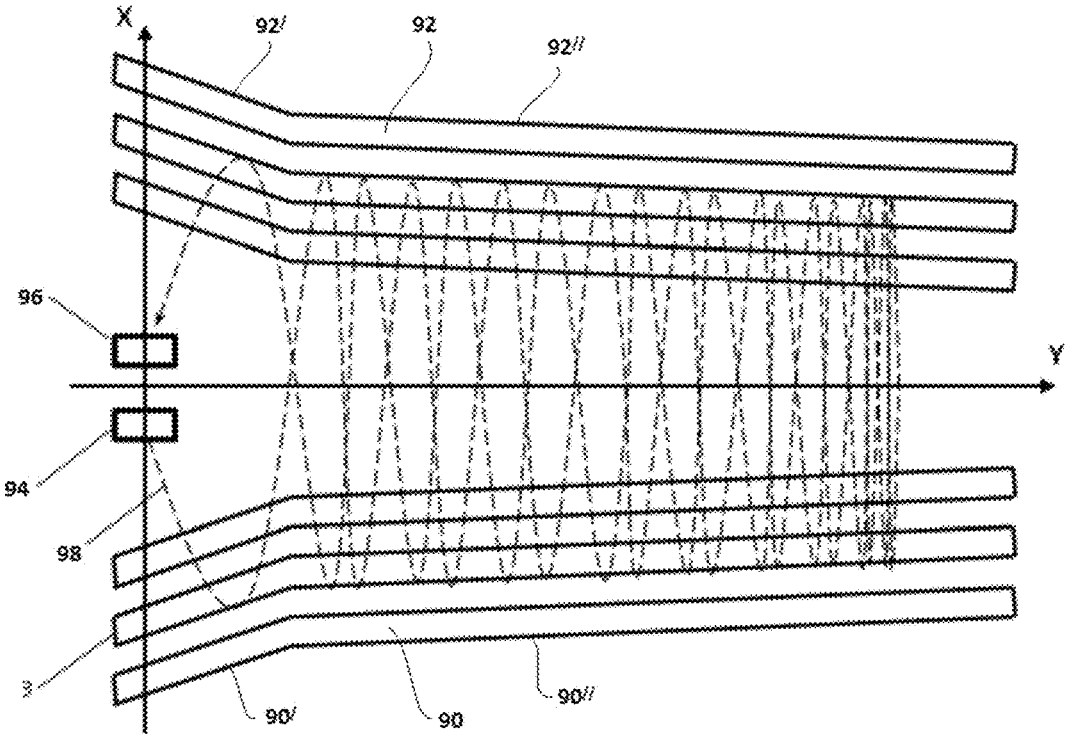
FIG. 8 is a schematic diagram of a mass spectrometer embodying the present invention having two opposing ion mirrors that converge in two different linear stages.

Referring to FIG. 8, there is shown a schematic diagram of a simple design embodying the present invention having two opposing ion mirrors 90, 92 that converge in two different linear stages. The return pseudo-potential provided by this embodiment is of the two linear stage type shown by lines 82, 84 in FIG. 7. First mirror 90 converges towards the other mirror in a first stage or portion 90′ of higher degree of convergence and a second or portion stage 90″ of lower degree of convergence. Second mirror 92 similarly converges in a first stage or portion 92′ and a second stage or portion 92″. In other words, the first stage or portion 90′, 92′ of each mirror has a higher angle of inclination to the direction Y than the second stage or portion 90″, 92″ of the mirror. Both mirrors are matched, i.e. are symmetric. In other embodiments, however, it could be designed so that only one mirror has the higher inclination angle in the first portion built into it, which would be the mirror that the ions strike first after leaving the ion injector (in this case, first mirror 90).

In FIG. 8, a beam of ions is injected from an ion injector or ion source 94 (such as an ion trap, orthogonal acceleration injector or MALDI source) and follows a trajectory 98 into the space between two sets of inclined elongated ion mirrors 90, 92. As an ion trap for the ion injector in the present invention, an RF storage multipole can be used. Ions enter the storage multipole in the X-Y plane from an ion guide and are stored in it whilst at the same time losing their excessive energy (becoming thermalised) in collisions with a bath gas (preferably nitrogen) contained within the multipole. After a sufficient number of ions are accumulated, the RF is switched off as described in WO2008/081334 and a bipolar extraction voltage applied to all or some electrodes of the storage multipole to eject the ions towards the first mirror. For example, push-pull voltages can be applied to the multipole. Upon ejection from the multipole, the ions are accelerated by the acceleration voltage V, preferably in the range 5-30 kV. Alternatively, an orthogonal ion accelerator can be used to inject the ion beam into the mass spectrometer as described in the U.S. Pat. No. 5,117,107 (Guilhaus and Dawson, 1992).

Figure 9:
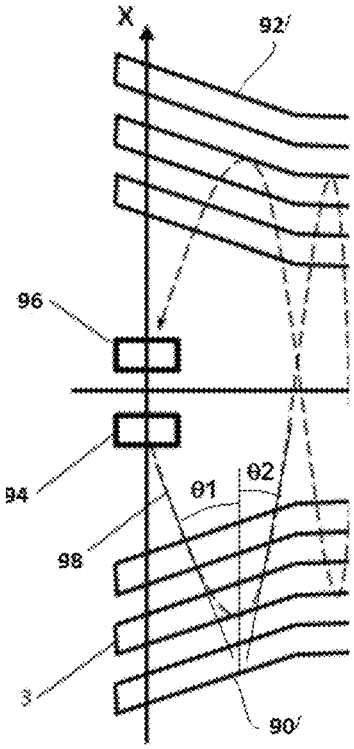
FIG. 9 is a schematic diagram showing detail of the mass spectrometer of FIG. 8 in which the ion trajectory shows ions initially entering the ion mirrors with an inclination angle to the X direction.

At low drift displacement, i.e. in the first portion of length, the mirrors have a higher degree of mirror convergence, i.e. in portion 90′ and 92′, leading to rapid loss of ion velocity in the drift direction Y. As shown in the detail of FIG. 9, the ions on trajectory 98 initially enter the ion mirrors with an inclination angle $\theta 1$ to the X direction but after reflection in the first portion of the ion mirrors the rapid loss of ion velocity in the drift direction Y reduces the inclination angle to $\theta 2$ ($\theta 2<\theta 1$). Subsequently, following a zig-zag path between the two mirrors, the ions enter the second portion of the mirrors having the lower degree of mirror convergence, wherein ion drift velocity continues to be lost but more slowly (i.e. on average a lower loss per reflection), before the ions are eventually reflected back up the drift length, following a reverse path between the mirrors that terminates with ions striking a detector 96 positioned adjacent the ion injector (at substantially the same Y coordinate).

In the embodiment shown in FIG. 8, there is only one reflection of the ions in the first portion of the mirror length of higher convergence, which is in the first ion mirror 90′. In other embodiments, further rapid reductions in ion drift velocity could be effected by arranging for one or more additional reflections in the first portion of the mirror length. For the two linear stage design, a main consideration is that no portion of the ion beam is arranged to be within the mirror structure when the beam is passing between the two stages of the mirrors. Where a portion of the ions reach the mirror in the low convergence stage (second stage) at the same time as the remaining ions reach the mirror in the high convergence stage (first stage), the drift energy divergence of the ion beam will increase and the ions scatter uncontrollably. This imposes a minimum drift velocity into the second stage that is dependent on the mirror separation and the spatial divergence of the ion beam at that point. As the ion beam diverges with increasing Y, it is preferable to have the ion beam transition between the stages as early as possible, and especially between the first and second reflections as shown in FIG. 8.

Figure 10:
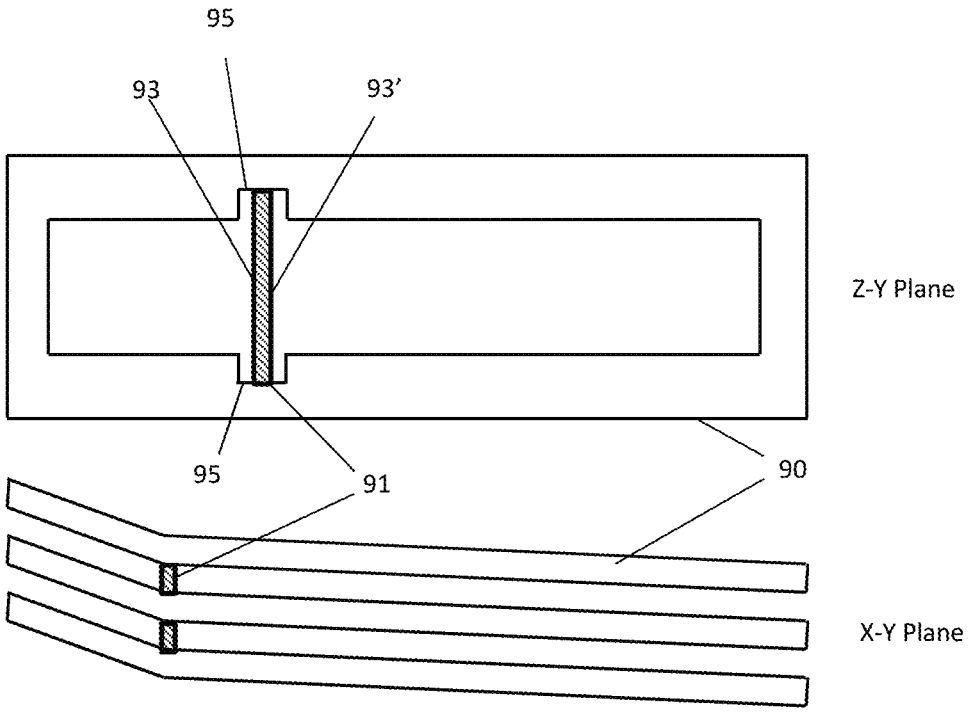
FIG. 10 is a schematic diagram showing a two stage mirror of a mass spectrometer according to the present invention, incorporating a field compensation PCB at the interface of the stages.
Figure 11:
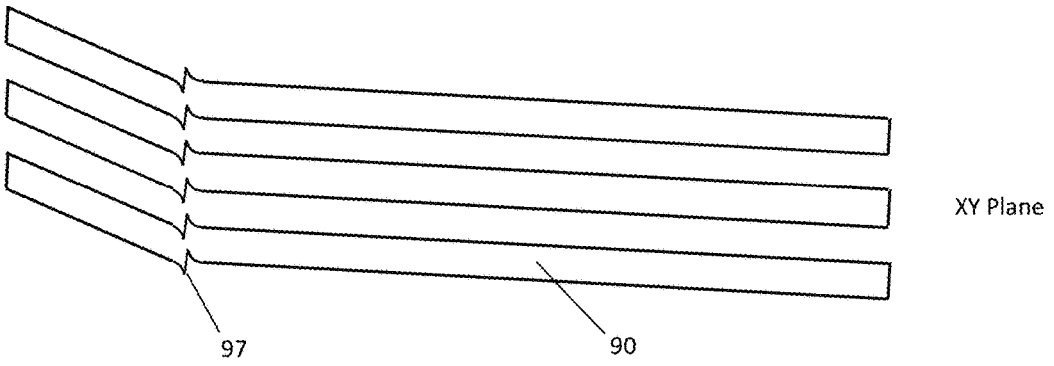
FIG. 11 is a schematic diagram showing a two stage mirror of a mass spectrometer according to the present invention, incorporating a correcting distortion at the interface of the stages.
Figure 12:
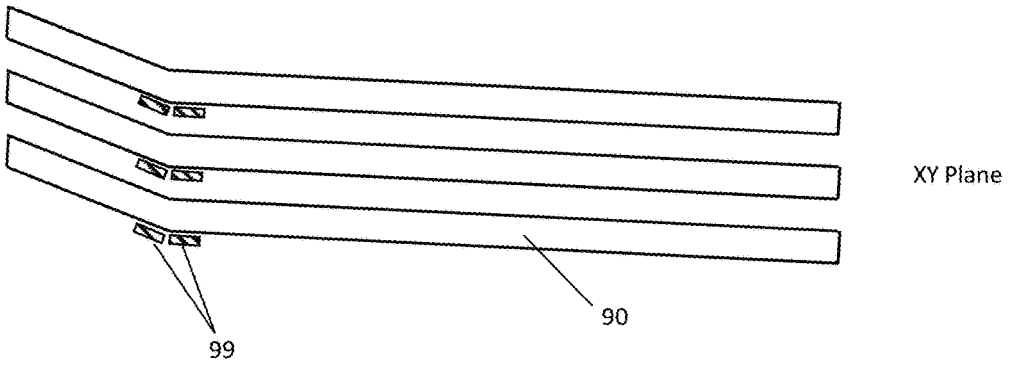
FIG. 12 is a schematic diagram showing a two stage mirror of a mass spectrometer according to the present invention, incorporating axial field correcting electrodes at the interface of the stages.

A related problem that can arise in some embodiments is that a field sag between the two stages can cause some drift energy broadening, even at a distance to the corner that separates the two regions. It is therefore desirable to apply a correction to minimise this field disturbance. One way to accomplish this is to mount printed circuit board (PCB) based field correcting electrodes through the mirror at the corner where convergence changes. Such an embodiment of a two stage mirror with a field compensation PCB is shown in FIG. 10. The PCB 91 is held in place at its top and bottom edge (in Z direction) by recesses 95 in the mirror electrodes. The two faces (93, 93') of the field correcting PCB 91 are printed with electrode tracks, which have slightly different track extents and/or applied voltages to mimic continuation of the stages. Other embodiments of electrodes mounted or printed on opposite faces of an insulating substrate than PCB could be used. Another method is to incorporate a small distortion in the mirror surface at the corner, so that the first stage of higher mirror convergence ends with a small increase in convergence, and stage 2 commences with a small decrease. Such an embodiment is such in FIG. 11, wherein a correcting modification 97 to the mirror 90 is shown that provides a distortion in the mirror surface at the corner between the two mirror stages. This effect could also be mimicked using small pairs of electrodes 99 hung from the mirror electrodes 90 (e.g. with insulating mountings) at the transition point between the two stages as shown in FIG. 12.

Each mirror is made of a plurality of elongated bar electrodes, the electrodes elongated generally in the direction Y (although not parallel to Y) as described in US2015/0028197. The elongated electrodes of the ion mirrors may be provided, for example, as mounted metal bars or as metal tracks on a PCB base. The elongated electrodes may be made of a metal having a low coefficient of thermal expansion such as Invar such that the time of flight is resistant to changes in temperature within the instrument. The electrode shape of the ion mirrors can be precisely machined or obtained by wire erosion manufacturing. The electrode dimensions, positions and applied electrical voltages are optimized such that the oscillation time, T, of ions between the mirrors, is substantially independent of the ion energy, $\varepsilon$, in the interval $\varepsilon_0+/-(\Delta\varepsilon/2)$, where $\varepsilon_0=qV$ is the reference energy defined by the acceleration voltage V and the ion charge q. The ion charge is herein assumed positive without loss of generality of the invention's applicability to both positive and negative ions.

In some embodiments, the two stages of the mirrors need not be formed by the same sets of bar electrodes. The elongated mirrors can instead be separated electrically at the transition point between the stages, or the mirrors can be built from entirely different structures at added cost and complexity. This electrical separation would have some advantage in allowing a partial retune of the instrument.

Figure 15:
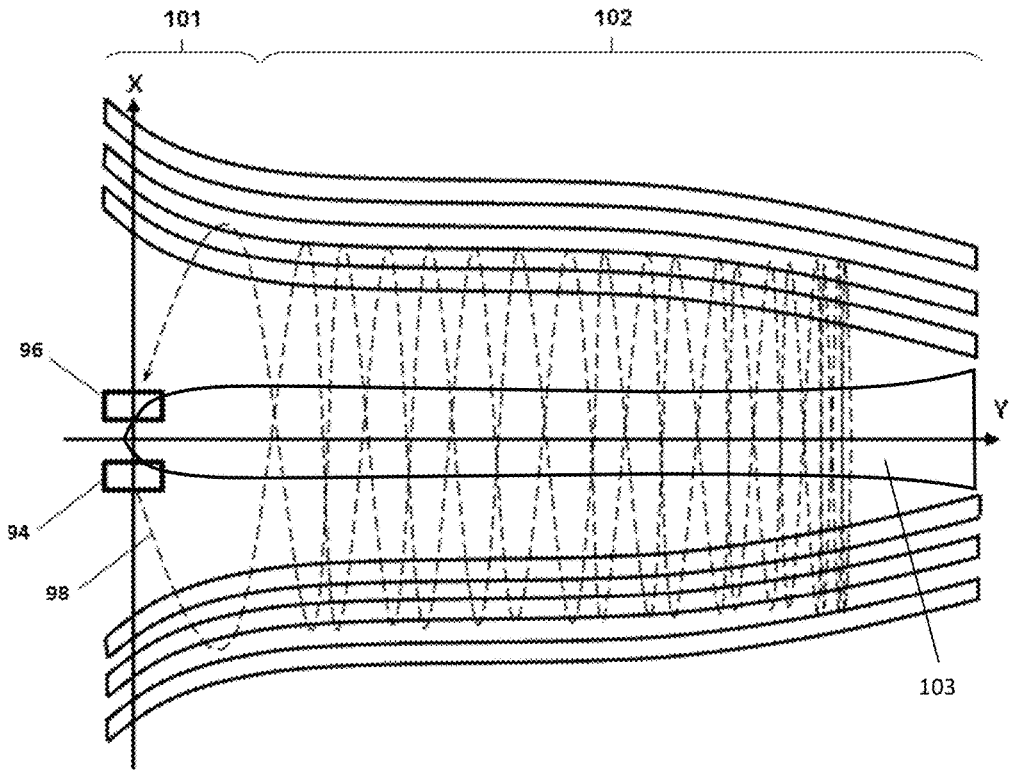
FIG. 15 is a schematic diagram showing a mass spectrometer according to the present invention, incorporating a mirror set including a curved first stage of higher degree of convergence and a curved second stage of lower degree of convergence and having a central stripe compensation electrode.

It is most preferable for systems incorporating the invention to include compensation electrodes in or adjacent the space between the mirrors to minimise the impact of time of flight aberrations caused by the change in distance between the mirrors, as described above and in US2015/0028197 A1. One such embodiment is shown in FIG. 15 as described below.

Neither the first nor second stages of the mirror convergence need be linear. Indeed the corner that is present at the transition between two linear stages shown in FIG. 8 is undesirable. The aberration introduced by the corner can be removed by blending the two stages together with a smooth curve, so that aberrations in drift energy dispersion are averaged out over multiple reflections. Embodiments can therefore be provided in which two linear stages are connected by a smooth curve. In some embodiments, for example in addition to the smooth curve joining the stages, the second stage of lower degree of convergence may be constructed with a portion (or its whole length) that follows a polynomial (preferably parabolic) shape so that the mirror has a convergence in the manner described in US2015/0028197 A1 or FIG. 5A above, which improves the Y spatial focus at the detector for ion beams with wide drift energy dispersion. This is preferable when handling decelerated ions as the drift energy dispersion increases substantially as a proportion of drift energy.

Figure 13:
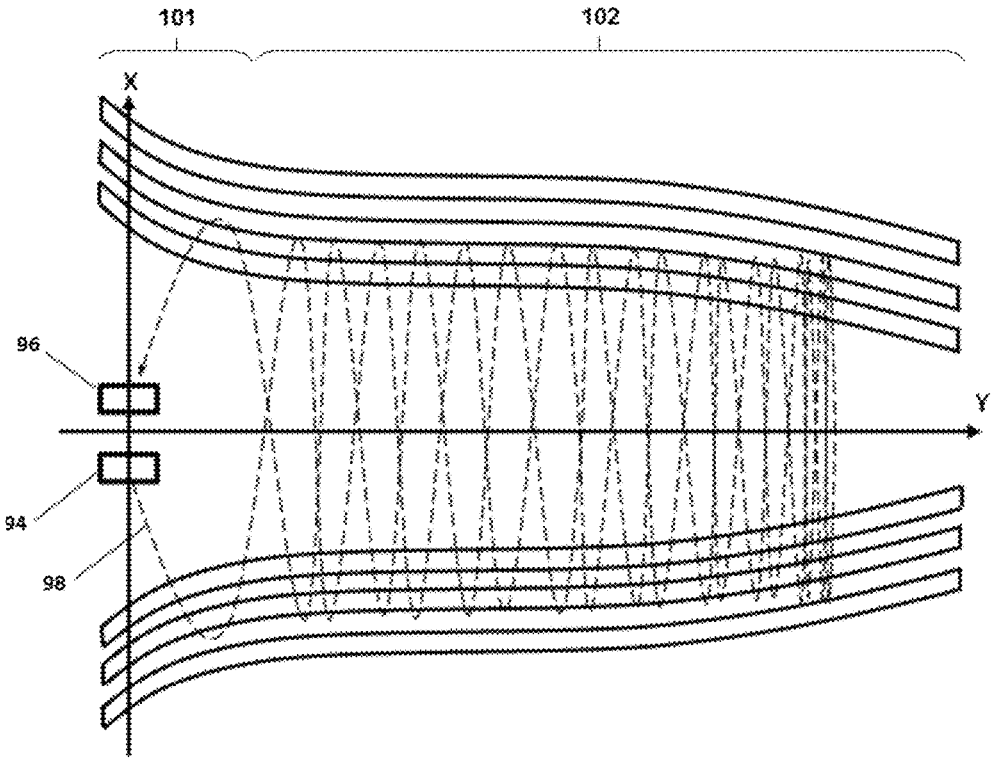
FIG. 13 is a schematic diagram showing a mass spectrometer according to the present invention, incorporating a mirror set including a curved first stage of higher degree of convergence and a curved second stage of lower degree of convergence.

FIG. 13 shows schematically a mass spectrometer according to the present invention, incorporating a mirror set including a curved first stage 101 of higher degree of convergence at low displacement along Y from the ion injector 94 for rapidly decelerating ions and allowing more reflections in the second stage, and a curved second stage of lower degree of convergence for reflecting the ions multiple times before the ions are eventually turned around by the pseudo potential of the curved mirrors to follow the return path to the detector 96.

Figure 14:
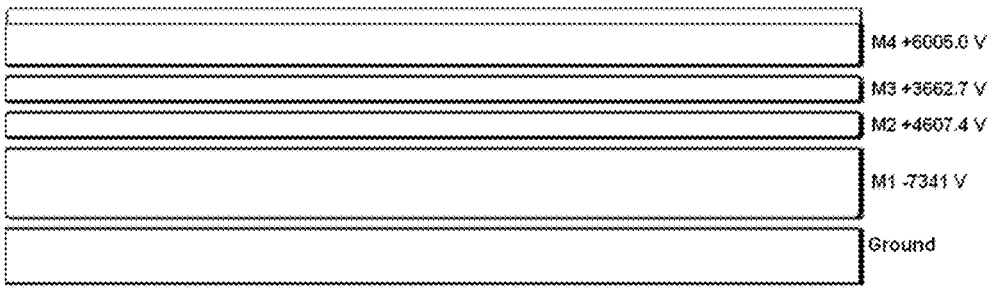
FIG. 14 is a schematic diagram showing a construction of ion mirror comprising bar electrodes with voltages applied.

A set of suitable dimensions and voltages for an embodiment as shown in FIG. 13 are as follows. The two ion mirrors have internal dimensions 175×450×48 mm (i.e. mirror depth (in X)×mirror length (in Y)×mirror height (in Z)), and are set opposed to each other with an inter-mirror gap of 320 mm. The mirrors are each constructed from five bar electrodes with voltages applied in the manner shown in FIG. 14 (for positive ions), which shows the bar electrodes schematically as linear although they are actually parabolic. Convergence of the mirrors follows a function generated by a mathematical optimisation, from 0 mm at Y=0 to 0.362 mm at the desired ion turning point 375 mm in the drift direction, i.e. the inter mirror gap is 320 mm at Y=0 and is 320-0.362 mm at the turning point (Y=375 mm). This function (1) is shown below, and increases the time of flight by >50% relative to a parabolic converging mirror of the prior art without a first, decelerating stage. This is equivalent to 30 oscillations of ions between the mirrors versus 20 in a system without the decelerating stage of the invention.

$$\text{Convergence}\ (Y) := \frac{0.8}{\pi}\cdot \operatorname{atan}(9.8175\cdot Y) - 0.1093\cdot Y^2 + 0.3471\cdot Y^3 - 0.1119\cdot Y^4 \quad (1)$$

Figure 16:
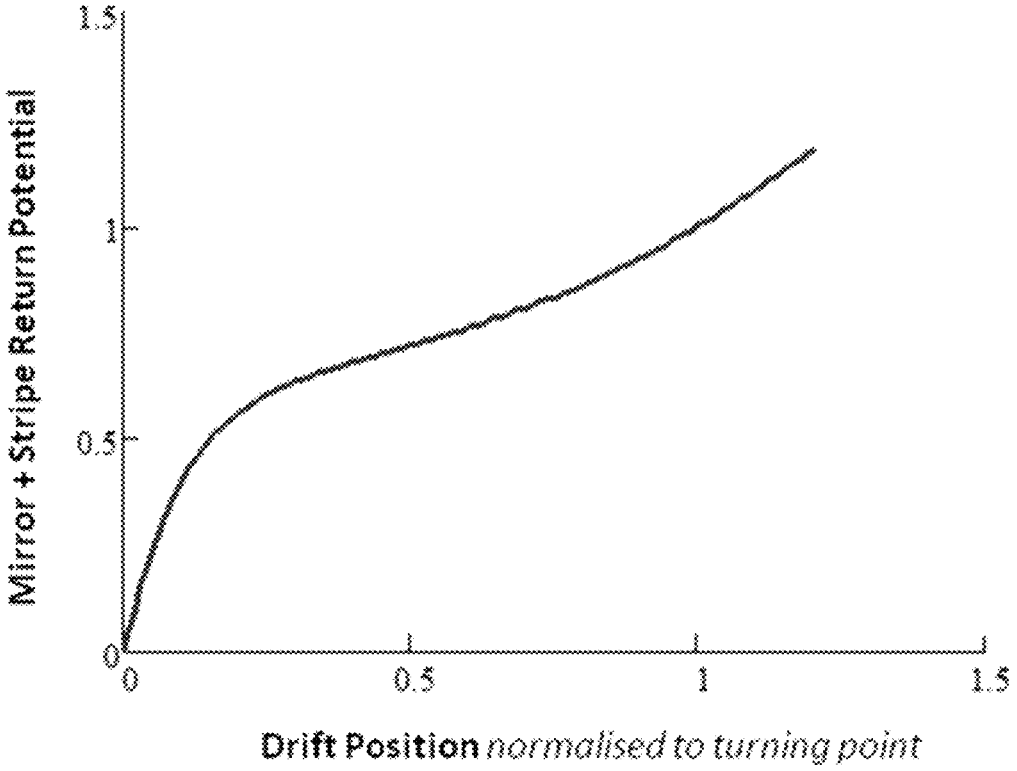
FIG. 16 is a graph showing the dimensionless sum of return pseudopotentials of the converging ion mirrors and a compensation electrode positioned therebetween.

The space between the mirrors is shared by compensation electrodes, more specifically between a grounded electrode and a shaped stripe electrode that runs the length of the mirrors and has an applied potential of +24.11 V. The grounded and stripe electrodes are planar having surfaces substantially parallel to the X-Y plane and are located either side of the space extending between the opposing mirrors. This electrode serves to counter the time of flight perturbation of the mirror convergence. The width occupied by the compensation stripe electrode expands from near 0 mm at the injection point to 120 mm at the turning point at Y=375 mm, with a shape following the same function as the mirror convergence but curving in the opposite direction, as shown in FIG. 15 wherein the stripe-shaped central compensation or correcting electrode is denoted 103. The mirror and the stripe electrode each form a return pseudopotential, the dimensionless sum of which is shown in FIG. 16.

In general, the compensation electrodes have a complex shape, extending in the X direction a varying amount as a function of the Y direction, the width of the biased stripe compensation electrodes in the X direction being represented by a function S(Y). The shapes of unbiased (grounded) electrodes are generally complementary to the shape of the biased electrodes. The biased compensation electrodes located adjacent or in the space between the ion mirrors can be positioned between two or more unbiased (grounded) electrodes in the X-Y plane that are also located adjacent or in the space between the ion mirrors.

Figure 17:
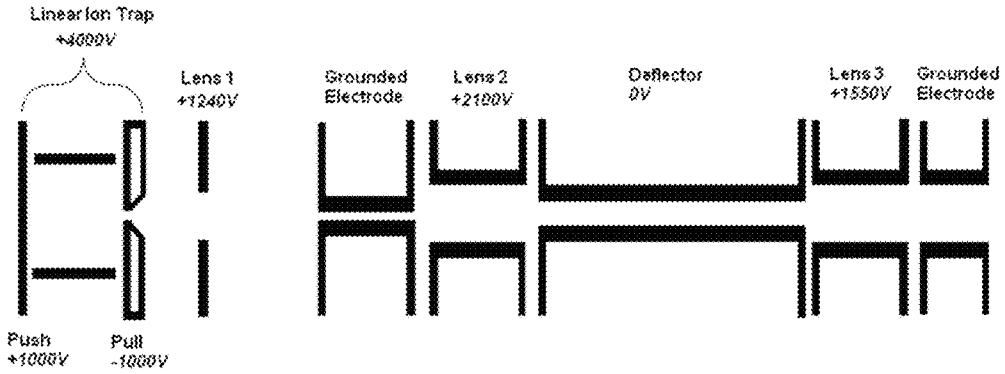
FIG. 17 is a schematic diagram of an ion injection optical arrangement for use with an embodiment of the invention with applied voltages shown.

Injection of ions into the analyser in this embodiment is performed with a linear ion trap with a 2 mm inscribed radius, with sufficient axial potential well to constrain the trapped ion cloud within ±3 mm. For the injection step, the trap is lifted to +4000 V and ions extracted by applying ~500 V/mm extraction field. Ion divergence into the first mirror is controlled by a set of three electrodes (lenses), and a deflector is present for fine tuning. The centre of the trap is set centrally between the mirrors in X, and at the Y=0 position in the drift dimension, and the trap is set at an inclination of 2.64 degrees to set the ion injection angle. This ion injection optical arrangement with applied voltages is shown in FIG. 17.

Figure 18:
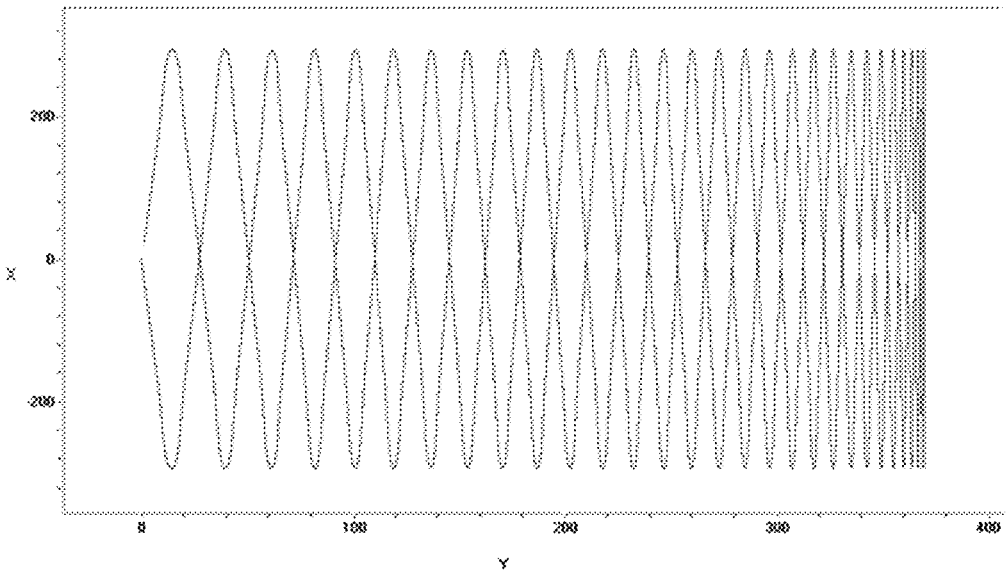
FIG. 18 is a plot of a simulated ion trajectory of an embodiment of the invention.

The detector plane is set 20 mm away from the trap in the lateral (X) direction, and at Y=0 in the drift direction, with a 2.6 degree tilt to match the angle of the ion isochronous plane. The simulated trajectory is traced in FIG. 18, with 30 turns or reflections in each mirror before the beam reaches the turning point in the Y direction.

Figure 19:
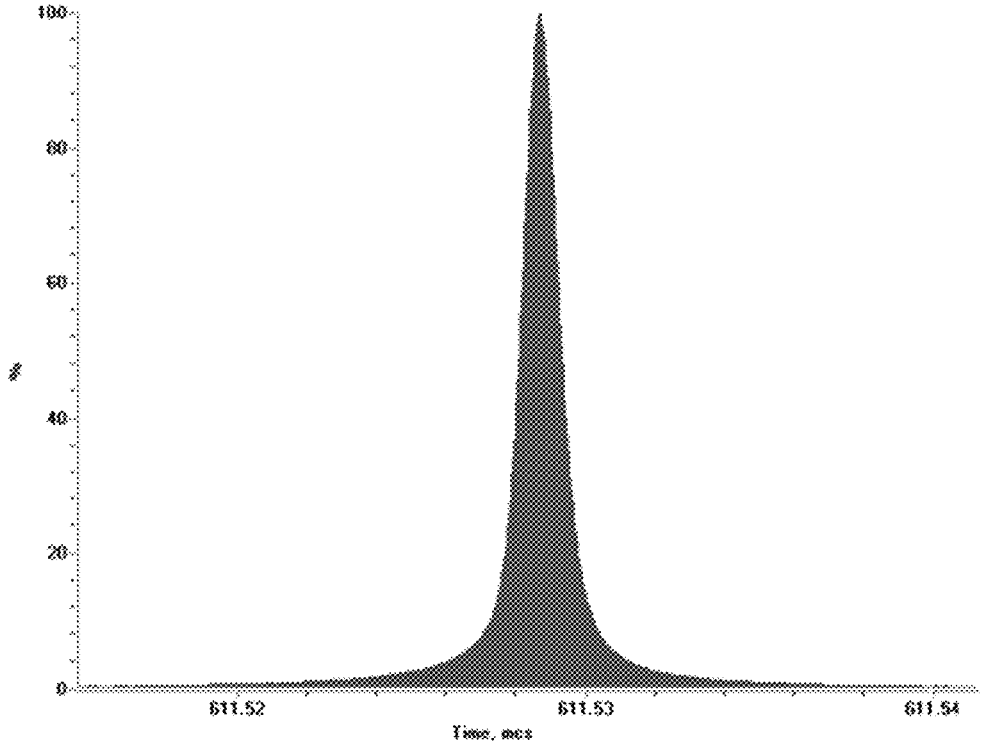
FIG. 19 is a graph of the time dispersion of ions with m/z=195 arriving at the detector in an embodiment of the present invention.
Figure 20:
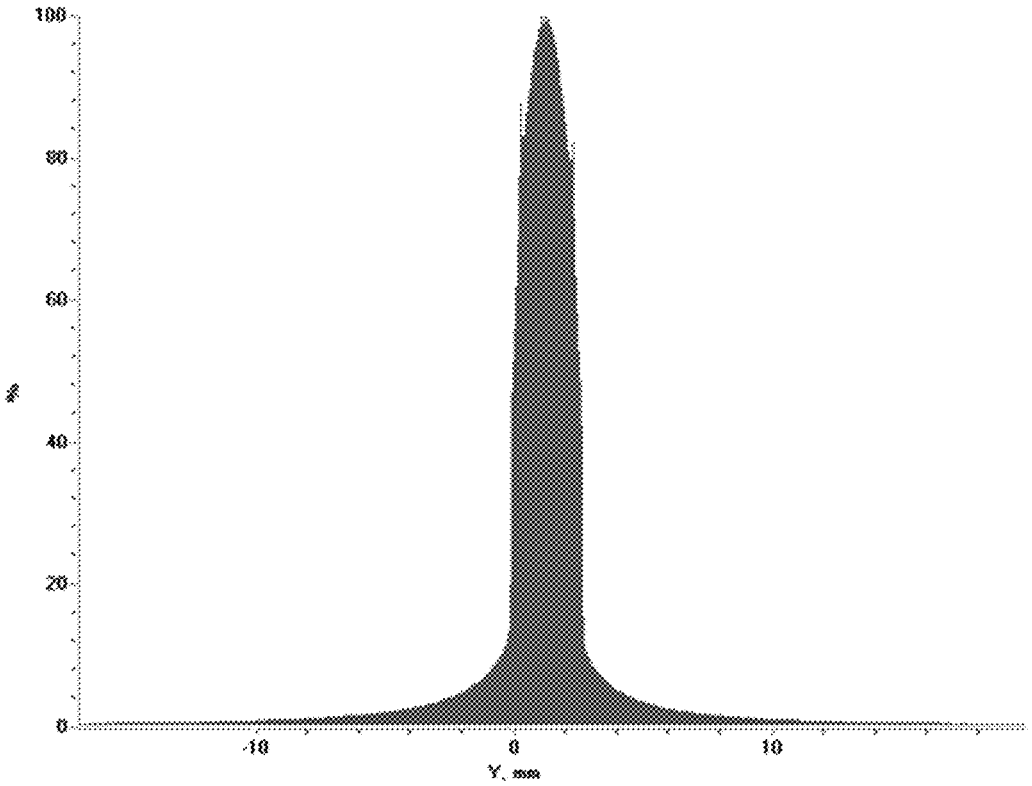
FIG. 20 is a graph of the spatial dispersion in direction Y of ions with m/z=195 arriving at the detector in an embodiment of the present invention.

The key measures of the performance of the system are the overall time of flight, the ion time focus, and the ion spatial focus at the detector. The first two define resolution and the last item the transmission and the presence of overtones were ions strike the detector one or more turns early. Compared to a prior art system without an initial decelerating stage, with the system specifications above the flight time of ions with m/z=195 was expanded from 408 to 612 μs, but the time focus (full width half maximum) also expanded slightly from 1 to 1.2 ns, giving an overall improvement in mass resolution from 200,000 to 255,000. The spatial spread along the detector also increased from a standard deviation of 0.95 to 1.16 mm, which is acceptable as nearly 100% of the ions should still strike within the confines of the detector. Plots of the time and Y spatial dispersion at the detector are shown in FIGS. 19 and 20 respectively.

Higher decelerating stages can also be considered, for example with time of flight increases of 2× and 2.5× that of a mirror without a decelerating stage. However, these mirror arrangements may demonstrate poor spatial focusing of the ion beam onto the detector, as the increasing proportional energy spread of the ion cloud overwhelms that of the mirrors. The increase in the Y-spread (full width at 1% relative intensity) of the ion cloud as increasing levels of deceleration are applied could be compensated by reducing the Y energy and spatial spread of the initial ion cloud, either with a smaller trap, improved ion cooling, or use of lenses with a Y field component in the injection optics.

Figure 21:
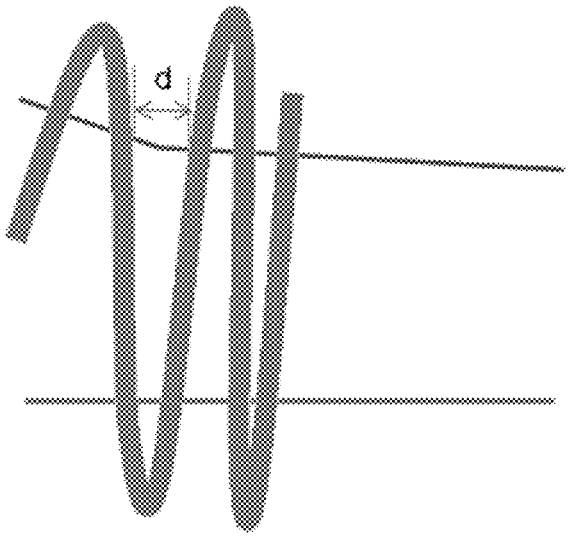
FIG. 21 is a schematic diagram depicting the spacing between adjacent beam envelopes within the mirror in the vicinity of the transition in the degree of convergence.

Although the ion beam is represented schematically in most of the drawings herein as a line without a significant width, in reality the ion beam occupies a region of space termed the beam envelope. Another preferred condition for the ion beam in the vicinity of the transition between the first and second portions of the mirror length (transition in the degree of convergence) is that the distance between two adjacent beam envelopes (i.e. the distance between the beam envelope on either side of the transition) within a mirror should not be smaller than a) 0.5*H, b) 1*H, or c) 2*H, where H is the local height of the mirror (local height meaning the internal height within the mirror, in the Z direction, at the transition). This is shown in FIG. 21, where the distance d between the beam envelopes within a mirror either side of the transition in the degree of convergence is indicated.

Multi-reflection mass spectrometers of the present invention are image-preserving and may be used for simultaneous imaging or for image rastering at a speed independent of the time of flight of ions through the spectrometer.

All embodiments presented above could be also implemented not only as ultra-high resolution TOF instruments but also as low-cost mid-performance analysers. For example, if the ion energy and thus the voltages applied do not exceed few kilovolts, the entire assembly of mirrors and/or compensation electrodes could be implemented as a pair of printed-circuit boards (PCBs) arranged with their printed surfaces parallel to and facing each other, preferably flat and made of FR4 glass-filled epoxy or ceramics, spaced apart by metal spacers and aligned by dowels. PCBs may be glued or otherwise affixed to more resilient material (metal, glass, ceramics, polymer), thus making the system more rigid. Preferably, electrodes on each PCB are defined by laser-cut grooves that provide sufficient isolation against breakdown, whilst at the same time not significantly exposing the dielectric inside. Electrical connections are implemented via the rear surface which does not face the ion beam and may also integrate resistive voltage dividers or entire power supplies.

For practical implementations the elongation of the mirrors in the drift direction Y should be minimised in order to reduce the complexity and cost of the design. This could be achieved by known means e.g. by compensating the fringing fields using end electrodes (preferably located at the distance of at least 2-3 times the height of mirror in Z-direction from the closest ion trajectory) or end-PCBs which mimic the potential distribution of infinitely elongated mirrors. In the former case, electrodes could use the same voltages as the mirror electrodes and might be implemented as flat plates of appropriate shape and attached to the mirror electrodes.

With the present invention, the incorporation of a decelerating stage into the mirror structure itself in the invention allows for an increase of the flight time and consequent resolution to be made without the requirement for an additional deflector to be incorporated between the mirrors, thus reducing the number of parts and cost. Furthermore, the minimum drift energy requirement to steer the ion beam around a deflector as proposed in the prior art is also removed. Whilst some requirement is imposed in the case where a sharp corner is formed at the end of the first, rapid decelerating stage, a decelerating stage based on curved opposing mirrors becomes advantageous as it greatly reduces this issue and the minimum drift energy ceases to be a function of the initial beam width; depending solely on the drift energy dispersion versus the energy acceptance of the reflecting stage.

As used herein, including in the claims, unless the context indicates otherwise, singular forms of the terms herein are to be construed as including the plural form and vice versa. For instance, unless the context indicates otherwise, a singular reference herein including in the claims, such as "a" or "an" means "one or more".

Throughout the description and claims of this specification, the words "comprise", "including", "having" and "contain" and variations of the words, for example "comprising" and "comprises" etc, mean "including but not limited to" and are not intended to (and do not) exclude other components.

It will be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

The use of any and all examples, or exemplary language ("for instance", "such as", "for example" and like language) provided herein, is intended merely to better illustrate the invention and does not indicate a limitation on the scope of the invention unless otherwise claimed. No language in the specification should be construed as indicating any non-claimed element as essential to the practice of the invention.

The invention claimed is:

1. A multi-reflection mass spectrometer comprising two ion mirrors spaced apart and opposing each other in an X direction, each mirror elongated generally along a drift direction Y, the X direction being orthogonal to the drift direction Y, and an ion injector for injecting ions as an ion beam into the space between the ion mirrors at an inclination angle to the X direction, wherein along a first portion of their length in the drift direction Y the ion mirrors converge with a first degree of convergence and along a second portion of their length in the drift direction Y the ion mirrors converge with a second degree of convergence or are parallel, the first portion of their length being closer to the ion injector than the second portion and the first degree of convergence being greater than the second degree of convergence.

2. The multi-reflection mass spectrometer of claim 1 wherein the first degree of convergence is such that the drift velocity of the ions in the direction Y is reduced across the first portion of length by at least 5% after the ions undergo one or more reflections in the ion mirrors in the first portion of length.

3. The multi-reflection mass spectrometer of claim 1 wherein the ions exhibit a greater average reduction in their drift velocity in the direction Y per reflection in at least one of the ion mirrors in the first portion of length compared to the average reduction in their drift velocity in the direction Y per reflection in the ion mirrors in the second portion of length.

4. The multi-reflection mass spectrometer of claim 1 wherein a return pseudo-potential gradient is generated by the converging mirrors along the first portion of the length that is greater than a return pseudo-potential gradient generated by the converging mirrors along the second portion of the length.

5. The multi-reflection mass spectrometer of claim 1 wherein, in use, the ion injector injects ions from one end of the mirrors into the space between the mirrors such that ions are reflected from one opposing mirror to the other a plurality of times whilst drifting along the drift direction away from the ion injector so as to follow a generally zigzag path within the mass spectrometer.

6. The multi-reflection mass spectrometer of claim 1, wherein the ion injector is located proximate to one end of the opposing ion-optical mirrors in the drift direction Y.

7. The multi-reflection mass spectrometer of claim 1, further comprising a detector located in a region adjacent the ion injector.

8. The multi-reflection mass spectrometer of claim 1, wherein along the first and/or second portions of its length the elongation generally in the drift direction Y of each mirror is linear.

9. The multi-reflection mass spectrometer of claim 1, wherein along the first and second portions of its length the elongation generally in the drift direction Y of each mirror is non-linear.

10. The multi-reflection mass spectrometer of claim 1, wherein at least one ion mirror curves towards the other mirror along at least one of the first and second portions of its length in the drift direction.

11. The multi-reflection mass spectrometer of claim 1, wherein both ion mirrors are shaped so as to produce in one or both of the first and second portions of length a curved reflection surface following a polynomial shape.

12. The multi-reflection mass spectrometer of claim 1, wherein along the second portion of their length in the drift direction Y, the ion mirrors are substantially non-parallel.

13. The multi-reflection mass spectrometer according to claim 1 wherein along the second portion of their length in the drift direction Y, the ion mirrors are substantially parallel.

14. The multi-reflection mass spectrometer of claim 1 wherein both mirrors are symmetrical to each other and both mirrors are curved along their first and/or second portions of length to follow a parabolic shape so as to curve towards each other as they extend in the drift direction.

15. The multi-reflection mass spectrometer of claim 1 wherein no portion of the ion beam is within an ion mirror when the ion beam passes between the first and second portions of the length in the direction Y.

16. The multi-reflection mass spectrometer of claim 1 wherein the transition between the first and second portions of the length in the direction Y occurs between first and second reflections in the opposing ion mirrors following injection.

17. The multi-reflection mass spectrometer of claim 1 wherein a distance between two adjacent envelopes of the ion beam within a mirror on either side of a transition between the first and second portions of the length is not smaller than 0.5*H, where H is local height of the mirror at the transition.

18. The multi-reflection mass spectrometer of claim 1 wherein one or more correction electrodes are mounted through the ion mirrors to reduce an electric field sag at the transition between the first and second portions of the length in the direction Y.

19. The multi-reflection mass spectrometer of claim 1 wherein the transition between the first and second portions of the length in the direction Y is a smooth curve.

20. The multi-reflection mass spectrometer of claim 1 wherein the first and second portions of the length in the direction Y are provided by the same continuous electrodes.

21. The multi-reflection mass spectrometer of claim 1 wherein the first and second portions of the length in the direction Y are electrically separated.

22. The multi-reflection mass spectrometer of claim 1 further comprising one or more compensation electrodes extending along at least a portion of the drift direction in or adjacent the space between the mirrors.

23. The multi-reflection mass spectrometer according to claim 22 comprising a pair of opposing compensation electrodes, each electrode being located either side of a space extending between the opposing mirrors.

24. The multi-reflection mass spectrometer according to claim 23 in which each of the compensation electrodes has a surface substantially parallel to the X-Y plane and having a polynomial profile in the X-Y plane such that the surfaces extend towards each mirror a lesser distance in the regions near one or both the ends of the mirrors than in the central region between the ends.

25. The multi-reflection mass spectrometer according to claim 22 in which each of the compensation electrodes has a surface substantially parallel to the X-Y plane and having a polynomial profile in the X-Y plane such that the surfaces extend towards each mirror a greater distance in the regions near one or both the ends of the mirrors than in the central region between the ends.

26. The multi-reflection mass spectrometer according to claim 22 in which the one or more compensation electrodes are, in use, electrically biased so as to produce, in at least a portion of the space extending between the opposing mirrors, an electrical potential offset which varies as a function of the distance along the drift length.

27. The multi-reflection mass spectrometer according to claim 22 in which the one or more compensation electrodes are, in use, electrically biased so as to compensate for at least some of the time-of-flight aberrations generated by the opposing mirrors.

28. The multi-reflection mass spectrometer according to claim 22 in which the one or more compensation electrodes are, in use, electrically biased so as to compensate for a time-of-flight shift in the drift direction generated by the opposing mirrors and so as to make a total time-of-flight shift of a system substantially independent of variations of an initial ion beam trajectory inclination angle in the X-Y plane.

29. The multi-reflection mass spectrometer according to claim 1 in which the motion of ions along the drift direction is opposed by an electric field resulting from convergence of the mirrors towards each other along the first and second portions of their lengths in the drift direction.

30. The multi-reflection mass spectrometer according to claim 1 in which an electric field causes the ions to reverse their direction and travel back towards the ion injector.

31. A method of mass spectrometry comprising injecting ions from an ion injector into a space between two opposing ion mirrors of a multi-reflection mass spectrometer, wherein the ions are repeatedly reflected back and forth between the mirrors whilst they drift down a general direction of elongation, and detecting at least some of the ions during or after their passage through the mass spectrometer, the two ion mirrors opposing each other in an X direction, each mirror elongated generally along a drift direction Y, the X direction being orthogonal to the drift direction Y, wherein along a first portion of their length in the drift direction Y the ion mirrors converge with a first degree of convergence and along a second portion of their length in the drift direction Y the ion mirrors converge with a second degree of convergence or are parallel, the first portion of their length being closer to the ion injector than the second portion and the first degree of convergence being greater than the second degree of convergence.

32. The method of mass spectrometry according to claim 31 wherein the first degree of convergence is such that the drift velocity of the ions in the direction Y is reduced across the first portion of length by at least 5% after the ions undergo one or more reflections in the ion mirrors in the first portion of length.

33. The method of mass spectrometry according to claim 31 wherein the ions exhibit a greater average reduction in their drift velocity in the direction Y per reflection in at least one of the ion mirrors in the first portion of length compared to the average reduction in their drift velocity in the direction Y per reflection in the ion mirrors in the second portion of length.

34. The method of mass spectrometry according to claim 31 in which the amplitude of motion along X direction decreases along at least a portion of the drift length as ions proceed away from the ion injector.

35. The method of mass spectrometry according to claim 31 in which ions are injected into the multi-reflection mass spectrometer from one end of the opposing ion-optical mirrors in the drift direction.

36. The method of mass spectrometry according to claim 31 in which the ions are turned around after passing along a drift length in direction Y and proceed back along the drift length towards the location of ion injection.

37. The method of mass spectrometry according to claim 31 wherein no portion of the ion beam is within an ion mirror when the ion beam passes between the first and second portions of the length in the direction Y.

38. A multi-reflection mass spectrometer comprising two ion mirrors spaced apart and opposing each other in an X direction, each mirror elongated generally along a drift direction Y, the X direction being orthogonal to the drift direction Y, and an ion injector for injecting ions into the space between the ion mirrors at an inclination angle to the X direction, wherein at least one of the ion mirrors along a first portion of its length in the drift direction Y has a first non-zero angle of inclination to the direction Y and along a second portion of its length in the drift direction Y has a second non-zero angle of inclination to the direction Y that is less than the first non-zero angle of inclination to the direction Y or has zero angle of inclination to the direction Y, the first portion of length being closer to the ion injector than the second portion.

39. A multi-reflection mass spectrometer comprising two ion mirrors spaced apart and opposing each other in an X direction, each mirror elongated generally along a drift direction Y, the X direction being orthogonal to the drift direction Y, and an ion injector for injecting ions as an ion beam into the space between the ion mirrors at an inclination angle to the X direction, such that ions injected into the spectrometer are repeatedly reflected back and forth in the X direction between the mirrors whilst they drift down the Y direction of mirror elongation so as to follow a zigzag path, wherein the ion mirrors along a first portion of their length in the drift direction Y provide a first return pseudo-potential gradient for reducing the ion drift velocity in the drift direction Y, and the ion mirrors along a second portion of their length in the drift direction Y provide a second return pseudo-potential gradient for reducing the ion drift velocity in the drift direction Y or along the second portion of their length do not provide a return pseudo-potential, wherein the first return pseudo-potential gradient is greater than the second return pseudo-potential gradient and the first portion of length is closer to the ion injector than the second portion.

40. A multi-reflection mass spectrometer comprising two ion mirrors spaced apart and opposing each other in an X direction, each mirror elongated generally along a drift direction Y, the X direction being orthogonal to the drift direction Y, and an ion injector for injecting ions as an ion beam into the space between the ion mirrors at an inclination angle to the X direction, such that ions injected into the spectrometer are repeatedly reflected back and forth in the X direction between the mirrors whilst they drift down the Y direction of mirror elongation so as to follow a zigzag path, wherein the ion mirrors along a first portion of their length in the drift direction Y provide a first rate of deceleration of the ion drift velocity in the drift direction Y, and the ion mirrors along a second portion of their length in the drift direction Y provide a second rate of deceleration of the ion drift velocity in the drift direction Y or along the second portion of their length do not provide a deceleration of the ion drift velocity in the drift direction Y, wherein the first rate of deceleration of the ion drift velocity is greater than the second rate of deceleration of the ion drift velocity and the first portion of length is closer to the ion injector than the second portion.

* * * * *